US008948637B2

(12) United States Patent
Ohshika

(10) Patent No.: US 8,948,637 B2
(45) Date of Patent: Feb. 3, 2015

(54) IMAGE FORMING APPARATUS

(71) Applicant: Oki Data Corporation, Tokyo (JP)

(72) Inventor: Hirotaka Ohshika, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/197,514

(22) Filed: Mar. 5, 2014

(65) Prior Publication Data

US 2014/0255053 A1 Sep. 11, 2014

(30) Foreign Application Priority Data

Mar. 6, 2013 (JP) ..... 2013-043893
Nov. 27, 2013 (JP) ..... 2013-244937

(51) Int. Cl.
*G03G 15/06* (2006.01)

(52) U.S. Cl.
CPC ..... *G03G 15/06* (2013.01)
USPC ..... 399/53; 399/55

(58) Field of Classification Search
USPC ..... 399/53, 55
See application file for complete search history.

(56) References Cited

U.S. PATENT DOCUMENTS

2006/0051114 A1* 3/2006 Ng ..... 399/53

FOREIGN PATENT DOCUMENTS

JP 2006-220694 A 8/2006

* cited by examiner

*Primary Examiner* — Clayton E Laballe
*Assistant Examiner* — Jas Sanghera
(74) *Attorney, Agent, or Firm* — Muncy, Geissler, Olds & Lowe, P.C.

(57) ABSTRACT

An image forming apparatus includes a first image forming part that forms a first developer image representing an image by using a first developer; and a second image forming part that forms a second developer image serving as a base or covering of the first developer image by using a second developer. In a case where the first developer image and the second developer image are superimposed and formed on an image-formed body by the first image forming part and the second image forming part, amount of the first developer that is used to form the first developer image is increased as compared to a case where the first developer image is formed on the image-formed body by the first image forming part without being superimposed with the second developer image.

14 Claims, 16 Drawing Sheets

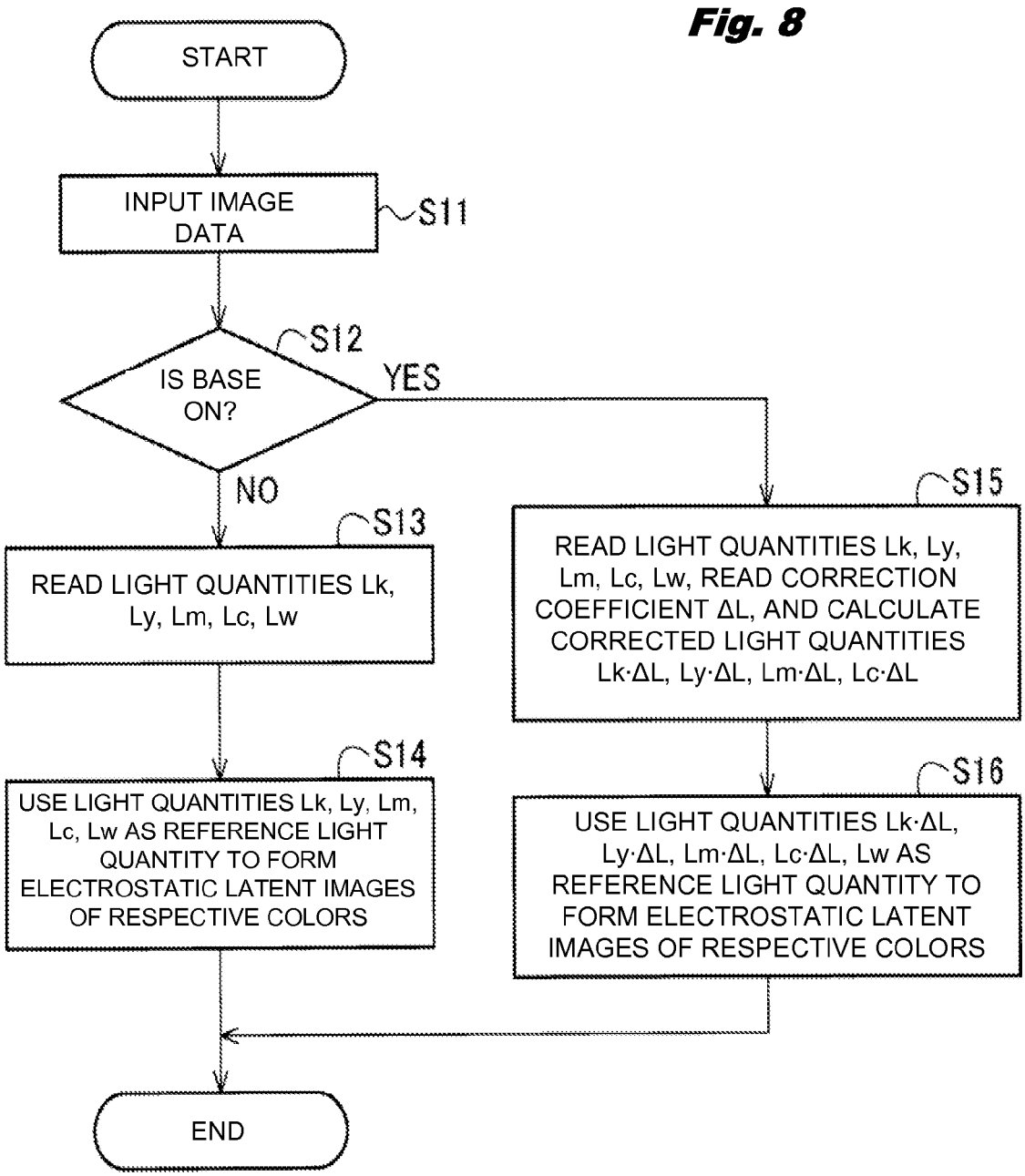
Fig. 8
START
INPUT IMAGE DATA
S11
S12
IS BASE ON?
YES
NO
S13
READ LIGHT QUANTITIES Lk, Ly, Lm, Lc, Lw
S14
USE LIGHT QUANTITIES Lk, Ly, Lm, Lc, Lw AS REFERENCE LIGHT QUANTITY TO FORM ELECTROSTATIC LATENT IMAGES OF RESPECTIVE COLORS
S15
READ LIGHT QUANTITIES Lk, Ly, Lm, Lc, Lw, READ CORRECTION COEFFICIENT ΔL, AND CALCULATE CORRECTED LIGHT QUANTITIES Lk·ΔL, Ly·ΔL, Lm·ΔL, Lc·ΔL
S16
USE LIGHT QUANTITIES Lk·ΔL, Ly·ΔL, Lm·ΔL, Lc·ΔL, Lw AS REFERENCE LIGHT QUANTITY TO FORM ELECTROSTATIC LATENT IMAGES OF RESPECTIVE COLORS
END

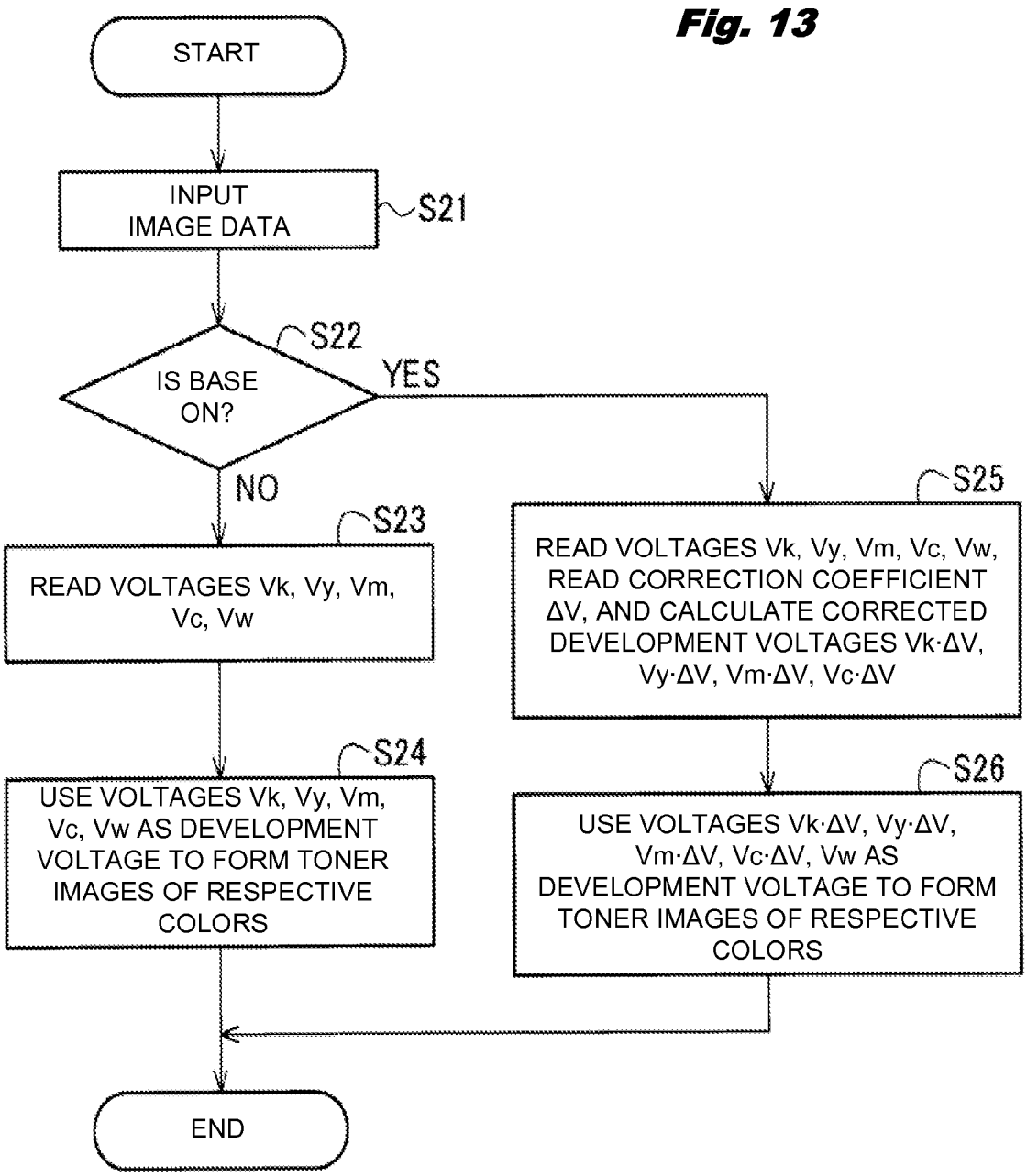
Fig. 13
START
INPUT IMAGE DATA
S21
S22
IS BASE ON?
YES
NO
S23
READ VOLTAGES Vk, Vy, Vm, Vc, Vw
S24
USE VOLTAGES Vk, Vy, Vm, Vc, Vw AS DEVELOPMENT VOLTAGE TO FORM TONER IMAGES OF RESPECTIVE COLORS
S25
READ VOLTAGES Vk, Vy, Vm, Vc, Vw, READ CORRECTION COEFFICIENT ΔV, AND CALCULATE CORRECTED DEVELOPMENT VOLTAGES Vk·ΔV, Vy·ΔV, Vm·ΔV, Vc·ΔV
S26
USE VOLTAGES Vk·ΔV, Vy·ΔV, Vm·ΔV, Vc·ΔV, Vw AS DEVELOPMENT VOLTAGE TO FORM TONER IMAGES OF RESPECTIVE COLORS
END

IMAGE FORMING APPARATUS

CROSS REFERENCE TO RELATED APPLICATION

The present application is related to, claims priorities from and incorporates by references Japanese Patent Application No. 2013-244937 filed on Nov. 27, 2013, and Japanese Patent Application No. 2013-043893 filed on Mar. 6, 2013.

TECHNICAL FIELD

The present invention relates to an image forming apparatus.

BACKGROUND

An image forming apparatus is disclosed in Japanese Patent Laid-Open Publication No. 2006-220694 in which a color toner image is formed on a transparent film by a plurality of development units containing a cyan toner, a yellow toner, a magenta toner and a black toner, and a white toner image is formed by a development unit containing a white toner on a side of the transparent film where the color toner image is formed.

In the above conventional technology, image quality is low. Improvement of the image quality is demanded.

SUMMARY

An image forming apparatus disclosed in the application includes a first image forming part that forms a first developer image representing an image by using a first developer; and a second image forming part that forms a second developer image serving as a base or covering of the first developer image by using a second developer. In a case where the first developer image and the second developer image are superimposed and formed on an image-formed body by the first image forming part and the second image forming part, amount of the first developer that is used to form the first developer image is increased as compared to a case where the first developer image is formed on the image-formed body by the first image forming part without being superimposed with the second developer image.

Also, an image forming apparatus disclosed in the application includes a first image forming part that forms a color first developer image; by using a color first developer; and a second image forming part that forms a white or transparent second developer image by using a white or transparent second developer. In a case where the first developer image and the second developer image are superimposed and formed on an image-formed body by the first image forming part and the second image forming part, amount of the first developer that is used to form the first developer image is increased as compared to a case where the first developer image is formed on the image-formed body by the first image forming part without being superimposed with the second developer image.

In specific examples disclosed in the following, the image quality is improved.

BRIEF DESCRIPTION OF DRAWINGS

FIG. 8 illustrates a flow diagram illustrating steps of exposure control in the first embodiment.

FIGS. 10A and 10B respectively illustrate a plan view and a cross-sectional view of a cyan toner image in an example of base ON.

FIG. 13 illustrates a flow diagram illustrating steps of development voltage control in the second embodiment.

DETAILED DESCRIPTION OF EMBODIMENTS

In the following, embodiments of the present invention are described with reference to the drawings.

First Embodiment

Configuration of Image Forming Apparatus

Figure 1:
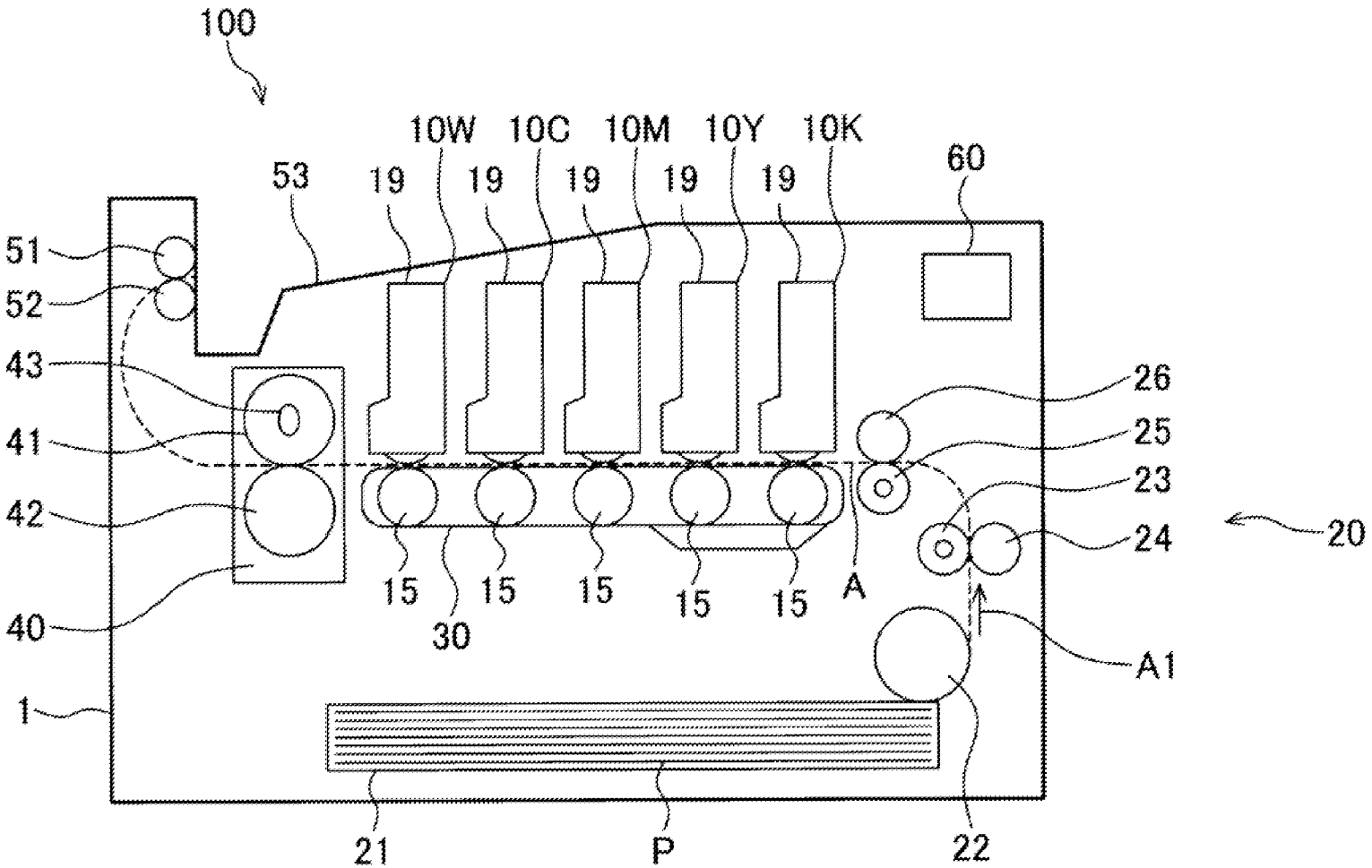
FIG. 1 illustrates a schematic cross-sectional view illustrating a configuration of an image forming apparatus in a first embodiment.

FIG. 1 illustrates a schematic cross-sectional view illustrating a configuration of an image forming apparatus 100 in a first embodiment. The image forming apparatus 100 is a print device that uses a developer to form an image using an electrographic method and is, in the present example, a printer capable of performing color printing.

The image forming apparatus 100 includes image forming parts 10K, 10Y, 10M, 10C as first image forming parts and an image forming part 10W as a second image forming part. In the present embodiment, the image forming parts 10K, 10Y, 10M, 10C each use a color developer other than a white developer as a first developer to form, on a print medium P as an image-formed body, a color developer image as a first developer image that represents an image. The image forming part 10W uses a white developer as a second developer to form, on the print medium P, a white developer image as a second developer image that serves as a base of a developer image that represents an image. Specifically, the image forming parts 10K, 10Y, 10M, 10C respectively use black (K), yellow (Y), magenta (M) and cyan (C) toners that are color toners to form color toner images of the respective colors. The image forming part 10W uses a white toner that is a toner of a white (W) color to form a white toner image that serves as a base of the color toner images. In the following description, the image forming parts 10K, 10Y, 10M, 10C may be referred to as "color image forming parts" and the image forming part 10W may be referred as a "white image forming part." In FIG. 1, a dashed line indicates a carrying route A of the print medium P, and an arrow A1 indicates a medium carrying direction along which the print medium P is carried. In an example of FIG. 1, along the carrying route A of the print medium P, from an upstream side in the medium carrying direction, the color image forming parts 10K, 10Y, 10M, 10C are arranged in this order and on a downstream side thereof (or at a most downstream position), the white image forming part 10W is arranged. The image forming parts 10K, 10Y, 10M, 10C, 10W will be described in detail later.

On an upstream side in the medium carrying direction of the image forming parts 10K, 10Y, 10M, 10C, 10W, a medium feed mechanism 20 is provided for feeding the print medium P to the image forming parts 10K, 10Y, 10M, 10C, 10W. The medium feed mechanism 20 has a print medium tray 21 that houses the print medium P, a hopping roller 22 that separates and brings out one by one the print medium P housed in the print medium tray 21, a roller pair of a registration roller 23 and a pinch roller 24 that carry the print medium P that is brought out, and a roller pair of a carrying roller 25 and a pinch roller 26 that send the print medium P from the registration roller 23 to the image forming parts. The registration roller 23 aligns a leading edge position of the print medium P and corrects a skew of the print medium P.

On a downstream side of the carrying roller 25 in the medium carrying direction, an endless carrying belt 30 is arranged that carries, while holding, the print medium P from the carrying roller 25. The carrying belt 30 carries the print medium P in a manner that the print medium P passes through the image forming parts 10K, 10Y, 10M, 10C, 10W in this order. On the print medium P that is carried by the carrying belt 30, toner images of the K, Y, M, C, W colors are formed in this order by the image forming parts 10K, 10Y, 10M, 10C, 10W.

On a downstream side medium carrying direction of the image forming parts 10K, 10Y, 10M, 10C, 10W, a fuser device 40 as a fuser is provided for fusing a toner image formed on the print medium P. Specifically, the fuser device 40 fuses the toner image on the print medium P by applying heat and pressure to the toner image. In the example of FIG. 1, the fuser device 40 includes a heat application roller 41 that is a heat application member, a pressure application roller 42 that is a pressure application member that is in contact with the heat application roller 41, and a heater 43 that is a heat generation member that heats the heat application roller 41. In this configuration, when the print medium P passes through the heat application roller 41 and the pressure application roller 42, heat and pressure are applied by the two rollers to the toner on the print medium P and the toner is fused onto the print medium P.

On a downstream side of the fuser device 40 in the medium carrying direction, a roller pair of an ejection roller 51 and a pinch roller 52 and a stacker part 53 are arranged, the ejection roller 51 ejecting the print medium P that has passed through the fuser device 40, and the stacker part 53 housing the print medium P ejected by the ejection roller 51.

Further, the image forming apparatus 100 includes a controller 60 that controls operation of the image forming apparatus 100. The controller 60 will be described in detail later.

In FIG. 1, a configuration is illustrated in which four image forming parts 10K, 10Y, 10M, 10C are included as the first image forming parts. However, the image forming apparatus 100 only needs to include at least one image forming part as the first image forming part. For example, among the image forming parts 10K, 10Y, 10M, 10C, the image forming part 10K containing a black toner may be omitted. In this case, black is represented by mixing yellow, magenta and cyan toners. In order to distinguish from pure black (or black due to a black toner), the black obtained by mixing the colors is referred to as process black. Further, the order in which the image forming parts 10K, 10Y, 10M, 10C are arranged is not limited to the order illustrated in FIG. 1, but may be changed as appropriate.

[Configuration of Image Forming Part]

Figure 2:
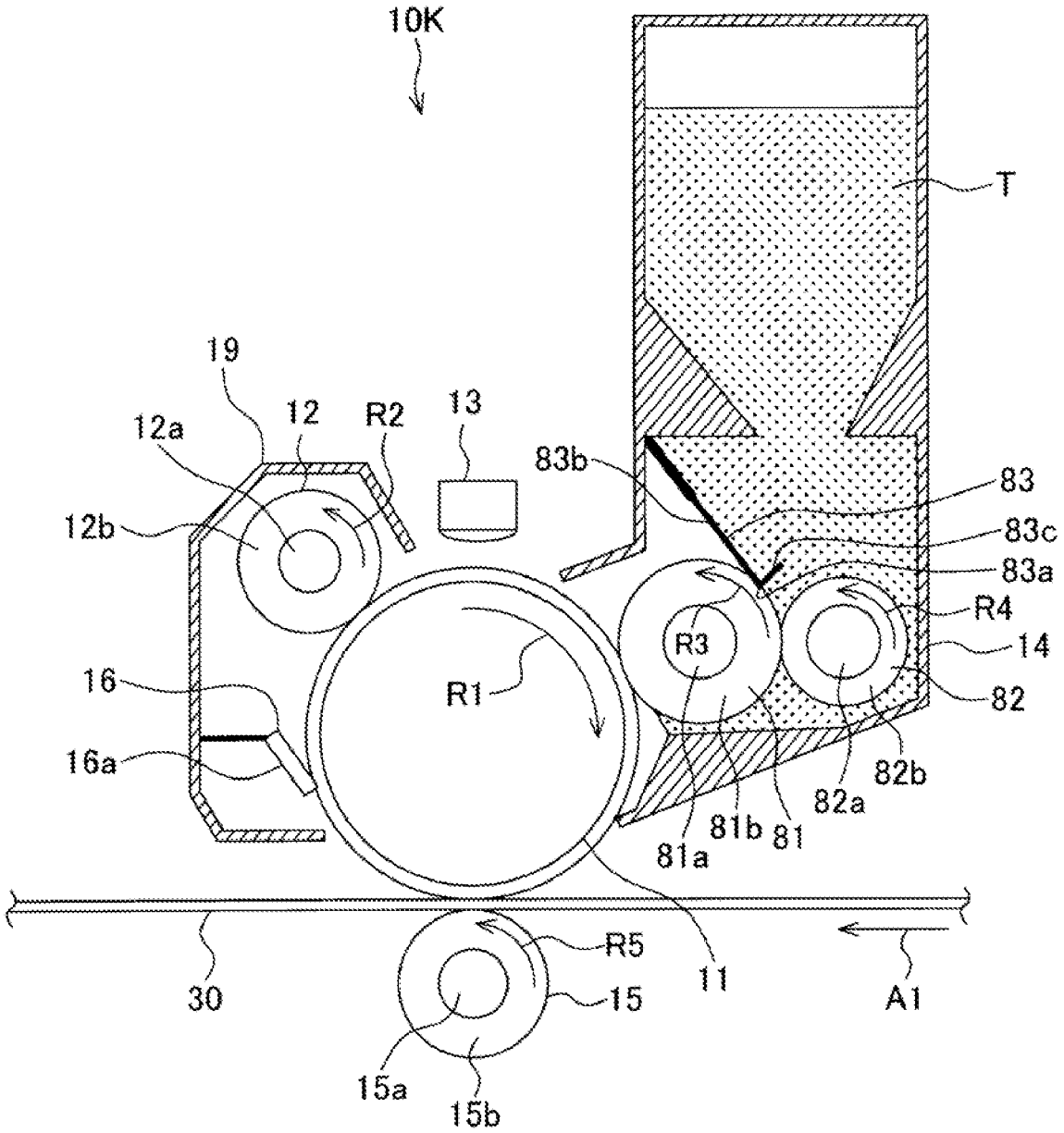
FIG. 2 illustrates a schematic cross-sectional view of an image forming part.

FIG. 2 illustrates a schematic cross-sectional view of the image forming part 10K. In the following, a configuration of the image forming part 10K is described with reference to FIG. 2. Configurations of the image forming parts 10Y, 10M, 10C, 10W are the same as that of the image forming part 10K and thus their description is omitted.

The image forming part 10K has a photosensitive drum 11 as an image carrier, a charging roller 12 as a charging part, a light source 13 as an exposure part, a development device 14 as a development part, a transfer roller 15 as a transfer part, and a cleaning device 16.

The photosensitive drum 11 is a member (or developer carrier) that carries an electrostatic latent image and a toner image. The photosensitive drum 11 rotates in an arrow R1 direction.

The charging roller 12 charges a surface of the photosensitive drum 11. The charging roller 12 is arranged to be pressed against the photosensitive drum 11 with a predetermined contact amount and is driven in association with the photosensitive drum 11 to rotate in an arrow R2 direction.

The light source 13 exposes the surface of the photosensitive drum 11 (that has been charged) to form an electrostatic latent image on the photosensitive drum 11. In this case, a light emitting diode (LED) is used in the light source 13.

The development device 14 develops the electrostatic latent image formed on the photosensitive drum 11 using a toner T to form a toner image on the photosensitive drum 11. Specifically, the development device 14 includes a development roller 81 as a developer carrier, a supply roller 82 as a developer supply member, and a development blade 83 as a developer regulating member. The development roller 81 carries the toner T and applies the toner T to the electrostatic latent image of the photosensitive drum 11 to form the toner image. The development roller 81 is arranged to be pressed against the photosensitive drum 11 with a predetermined contact amount and rotates in an arrow R3 direction. The supply roller 82 supplies the toner T to the development roller 81. The supply roller 82 is arranged to be pressed against the development roller 81 with a predetermined contact amount and rotates in an arrow R4 direction. The development blade 83 regulates an toner amount on the development roller 81 to form a uniform toner layer. The development blade 83 is arranged to be pressed against the development roller 81 with a predetermined contact amount.

The transfer roller 15 transfers the toner image formed on the photosensitive drum 11 onto the print medium P. The transfer roller 15 is arranged to be pressed against the photosensitive drum 11 with a predetermined contact amount via the carrying belt 30 and is driven in association with the photosensitive drum 11 to rotate in an arrow R5 direction.

The cleaning device 16 removes toner remained on the surface of the photosensitive drum 11 after the transferring.

In the present example, the photosensitive drum 11, the charging roller 12, the development device 14 and the cleaning device 16 are included in an image forming unit 19. As illustrated in FIG. 1, in a vertical direction (up-down direction in FIG. 1), the image forming unit 19 is arranged above the carrying route A and the carrying belt 30, and the transfer roller 15 is arranged below the carrying route A and the carrying belt 30. Further, the image forming unit 19 is removably installed with respect to a body 1 of the image forming apparatus 100. The light source 13 is provided above the photosensitive drum 11 on a body 1 side in a manner opposing the photosensitive drum 11.

Figure 3:
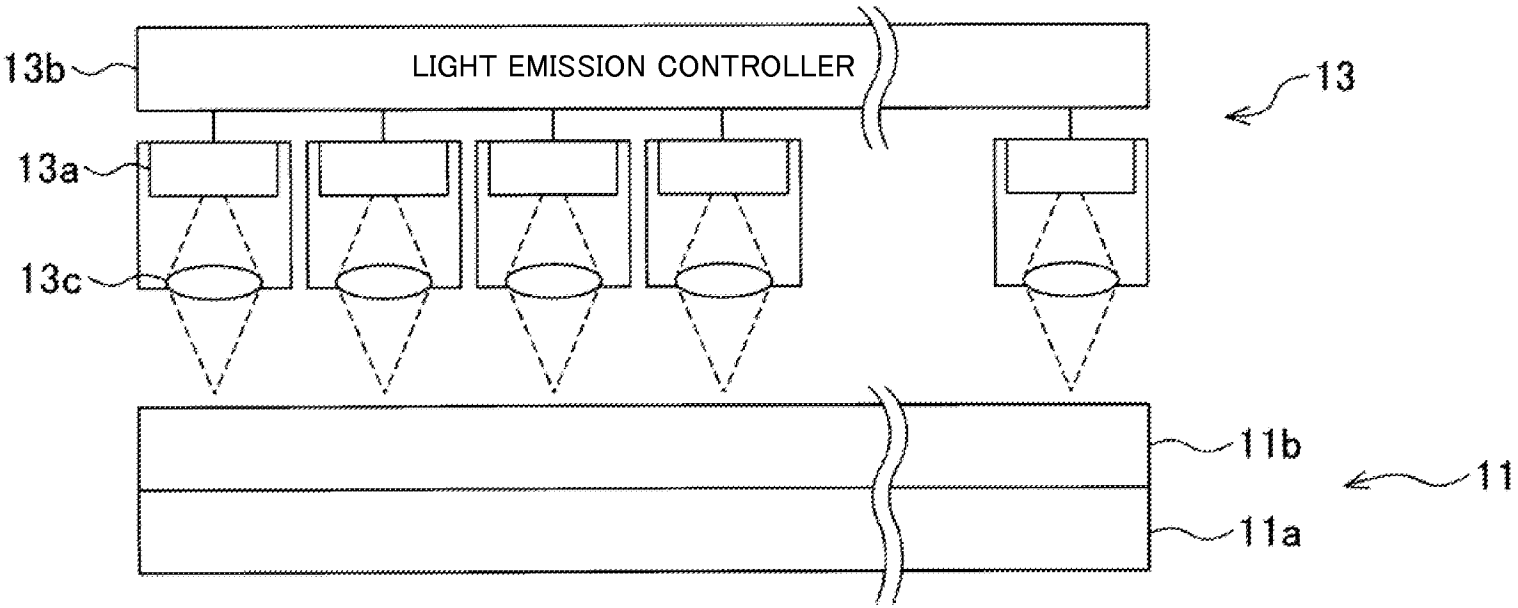
FIG. 3 illustrates a configuration of a photosensitive drum and a light source.

In the following, each component of the image forming part 10K is described in more detail. As illustrated in FIG. 3, the photosensitive drum 11 has a conductive supporting body 11*a* that is processed into a cylindrical shape and a photosensitive layer 11*b* that is formed by coating on the conductive supporting body 11*a*. On an end part of the conductive supporting body 11*a*, a photosensitive gear (not illustrated in the drawings) is attached for rotating the photosensitive drum 11. The conductive supporting body 11*a* is made of aluminum alloy having an outer diameter ϕ of 30 mm and thickness of 0.75 mm. The photosensitive layer 11*b* is formed by adding a charge transport agent, an antioxidant and the like to a binder resin.

As illustrated in FIG. 2, the charging roller 12 has a cylindrical metal shaft 12*a* and a semiconductive elastic layer 12*b* that is formed on a circumferential surface of the metal shaft 12*a*. The elastic layer 12*b* is formed using an epichlorohydrin rubber. A charging voltage Vch is applied to the metal shaft 12*a* of the charging roller 12 for charging the surface of the photosensitive drum 11 to a predetermined potential. The charging voltage Vch in this case is in a range from −1000 to −1100 V.

As illustrated in FIG. 3, the light source 13 is configured by a plurality of LEDs 13*a* that are arranged at a predetermined interval, a light emission controller 13*b* that causes the LEDs 13*a* to emit light, and a plurality of lenses 13*c* that are arranged in a manner causing the light emitted from the LEDs 13*a* to converge on the photosensitive drum 11. The number and the interval of the arrangement of the LEDs 13*a* may be appropriately determined depending on resolution (dpi) and the like. The light emission controller 13*b* controls, according to image data input from the controller 60, emission/non-emission of the respective LEDs 13*a* and light quantities of the respective LEDs 13*a* when emitting light. When one dot is formed using one LED 13*a*, the light quantity with which the photosensitive drum 11 is irradiated is controlled to be, for example, within a range of 0.1-1.0 μJ/cm2.

As illustrated in FIG. 2, the development roller 81 has a cylindrical metal shaft 81*a* and a semiconductive elastic layer 81*b* that is formed on a circumferential surface of the metal shaft 81*a*. On an end part of the metal shaft 81*a*, a development gear (not illustrated in the drawings) is attached for rotating the development roller 81. The development gear meshes with the photosensitive gear so that the development roller 81 is rotationally driven by the rotation of the photosensitive drum 11 at a constant circumferential speed difference with respect to the photosensitive drum 11. The elastic layer 81*b* is formed using a urethane rubber and a surface of the elastic layer 81*b* is subjected to an isocyanate treatment in order to improve chargeability of a toner. A development voltage Vd for attaching the toner on the development roller 81 to the electrostatic latent image of the photosensitive drum 11 is applied to the metal shaft 81*a*. The development voltage Vd in this case is in a range from −100 to −300 V.

The supply roller 82 has a cylindrical metal shaft 82*a* and a semiconductive foamed elastic layer 82*b* that is formed on a circumferential surface of the metal shaft 82*a*. The foamed elastic layer 82*b* is formed using a silicone rubber having excellent chargeability of a toner. On an end part of the metal shaft 82*a*, a supply gear (not illustrated in the drawings) is attached for rotating the supply roller 82. An idle gear (not illustrated in the drawings) is provided between the supply gear and the development gear so that the supply gear is linked via the idle gear to the development gear. As a result, the supply roller 82 and the development roller 81 rotate in the same rotation direction. A supply voltage Vs for supplying toner from the supply roller 82 to the development roller 81 due to a potential difference between the metal shaft 82*a* and the development roller 81 is applied to the metal shaft 82*a*. The supply voltage Vs in this case is in a range from −100 to −400 V.

The development blade 83 is formed by bending a stainless (SUS) plate having a thickness of 0.08 mm into an L shape. The development blade 83 has an edge portion 83*a* formed due to folding, and a long portion 83*b* and a short portion 83*c* of the L shape. The development blade 83 is installed in a manner that the long portion 83*b* is positioned on a downstream side of the edge portion 83*a* in the rotation direction R3 of the development roller 81 and the edge portion 83*a* is pressed against a surface of the development roller 81. That is, the development blade 83 is installed in a manner that the edge portion 83*a* is pressed against the development roller 81 in a counter direction. An end part of the long portion 83*b* on a side opposite to the edge portion 83*a* is fixed on a frame of the image forming unit 19. A voltage same as the supply voltage Vs that is applied to the supply roller 82 is applied to the development blade 83. However, a voltage different from the supply voltage Vs may be applied to the development blade 83.

The transfer roller 15 has a cylindrical metal shaft 15*a* and a semiconductive foamed elastic layer 15*b* that is formed on a circumferential surface of the metal shaft 15*a*. The foamed elastic layer 15*b* is formed using an epichlorohydrin rubber. A transfer voltage Vt for transferring the toner on the photosensitive drum 11 to the print medium P due to a potential difference between the metal shaft 15*a* and the photosensitive drum 11 is applied to the metal shaft 15*a*. The transfer voltage Vt in this case is in a range from +1000 to +5000 V.

The cleaning device 16 includes a plate-like elastic member (or cleaning blade) 16*a*. The plate-like elastic member 16*a* is installed in a manner that one end of the plate-like elastic member 16*a* is pressed against the surface of the photosensitive drum 11 with a predetermined contact amount, and scrapes off the toner on the photosensitive drum 11. A urethane rubber having excellent durability is used for the plate-like elastic member 16*a*.

In the following description, the alphabets K, Y, M, C, W that indicate colors are respectively attached as needed to the reference numeral symbols of the members of the image forming parts 10K, 10Y, 10M, 10C, 10W. For example, the photosensitive drums 11 of the image forming parts 10K, 10Y, 10M, 10C, 10W are respectively referred to as 11K, 11Y, 11M, 11C, 11W.

[Developer (Toner)]

In the following, the toners are described. The black, yellow, magenta, cyan and white toners are each configured by toner base particles and external additives (such as a charge control agent and an antioxidant) that are added to the toner base particles, the toner base particles being formed by mixing a binder resin (such as a polyester resin and a styrene-acrylic copolymer resin), a colorant and wax and causing the mixture to agglomerate.

Examples of pigments that are used as the colorants for the black, yellow, magenta and cyan color toners include carbon black, phthalocyanine blue, permanent brown FG, brilliant fast scarlet, pigment green B, rhodamine lake, quinacridone, carmine 6B, disazo yellow, and the like. The colorant is added at a ratio of 2-20 (parts by weight) with respect to 100 (parts by weight) of the binder resin. In contrast, for the white toner, an inorganic material is generally used as a colorant. Examples of the inorganic material include titanium oxide, zinc oxide and zinc sulfide. Here, the titanium oxide having a good contrast ratio is used. The titanium oxide that is a colorant is added at a ratio of 25-35 (parts by weight) with respect to 100 (parts by weight) of the binder resin in order to increase the contrast ratio.

Since the inorganic material is used as the colorant and a large amount of pigment is also added, the white toner has a large specific gravity as compared to the color toners of other colors (black, yellow, magenta and cyan). For example, the specific gravity of the white toner is 1.6-2.0 times of the specific gravity of the color toners.

The toners of the respective colors have a particle diameter of 5-9 μm, for example. In one example, average volume particle diameters are 5.7 for the black toner, 5.6 for the yellow toner, 5.6 for magenta toner, 5.6 for cyan toner and 7.0 μm for the white toner.

The toners of the respective colors have a circularity of 0.950-0.955, for example. Circularity of a particle measured using a flow type particle image analyzer FPIA-3000 (manufactured by Sysmex Corporation) is obtained using the following equation and the circularity of a toner is a value obtained by dividing a sum of circularities of all measured particles by the number of the all measured particles. Circularity=(Boundary length of a circle having a projected area the same as that of a particle image)/(Boundary length of a projection image of the particle). The circularity in the present embodiment is an indicator of a degree of irregularity of toner particles. When a toner particle is perfectly spherical, the circularity is 1.000. The more complex the shape of a toner particle is, the smaller the circularity becomes.

In one example, tightly-packed bulk densities of the toners are respectively 0.33, 0.34, 0.35, 0.33 and 0.58 g/cm$^3$ for black, yellow, magenta, cyan and white toners.

[Controller]

In the following, the controller 60 is described. The controller 60 controls an operation such as an image forming operation of the image forming apparatus 100 by controlling the parts of the image forming apparatus 100. Specifically, the controller 60 controls the image forming parts 10K, 10Y, 10M, 10C, 10W to form a toner image on the print medium P.

The controller 60 performs the forming in two ways, one way that a color toner image and a white toner image are superimposed, and the other way that a color toner image is formed without being superimposed with a white toner image. Specifically, the controller 60 controls the image forming parts 10K, 10Y, 10M, 10C, 10W to perform first image formation in which a color toner image and a white toner image are superimposed and formed on the print medium P and second image formation in which a color toner image is formed on the print medium P without being superimposed with a white toner image. More specifically, the controller 60 performs the first image formation in which a color toner image and a white toner image as a base of the color toner image are superimposed and formed, and performs the second image formation in which a color toner image is formed without being superimposed with a white toner image as a base of the color toner image. The white toner image as a base may be formed on an entire printable area of the print medium P and may also be formed on a portion of the printable area of the print medium P. In the following description, the first image formation is referred to as "base printing" and the second image formation is referred to as "ordinary printing."

Figure 4:
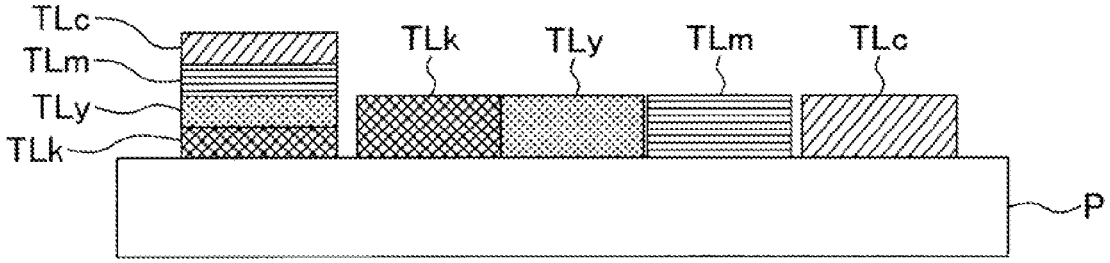
FIG. 4 illustrates a schematic cross-sectional view illustrating an example of a toner layer transferred onto a print medium in ordinary printing.

Here, the ordinary printing and the base printing are described. FIG. 4 illustrates a schematic cross-sectional view illustrating an example of a toner layer transferred onto the print medium P in the ordinary printing. As illustrated in FIG. 4, in the ordinary printing, a black toner layer TLk, a yellow toner layer TLy, a magenta toner layer TLm and a cyan toner layer TLc are formed on the print medium P. Typically, the print medium P is a white medium such as a paper medium and an image formed on the print medium P is observed from a toner layer side, that is, a printing surface side, of the print medium P.

Figure 5:
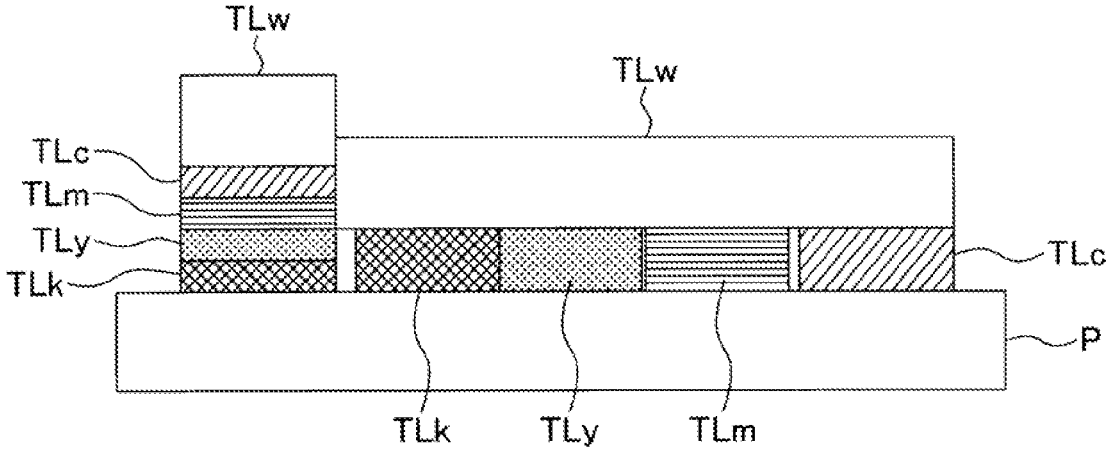
FIG. 5 illustrates a schematic cross-sectional view illustrating an example of a toner layer transferred onto a print medium in base printing.

FIG. 5 illustrates a schematic cross-sectional view illustrating an example of a toner layer transferred onto the print medium P in the base printing. As illustrated in FIG. 5, in the base printing, on the print medium P, a black toner layer TLk, a yellow toner layer TLy, a magenta toner layer TLm and a cyan toner layer TLc are formed, and further a white toner layer TLw is formed thereon. The white toner layer TLw is, for example, uniformly formed on the entire printable area of the print medium P and configures a base layer. Typically, the print medium P is a transparent medium such as a transparent film and an image formed on the print medium P is observed from an opposite side of the toner layer, that is, a non-printing surface side, of the print medium P. The white toner layer TLw is formed as a base or a white background of a color image to prevent transmission of light and functions to reproduce the same hue of the color image as that on a paper medium.

In an area where a color toner image and a white toner image are superimposed and formed, it is possible that image grade may decrease, such as that, due to mixing of the color toner and the white toner, a density of the color toner image may become lower than a desired density corresponding to the image data.

For example, when a white toner layer is superimposed and formed on a color toner layer as illustrated in FIG. 5, the following phenomenon occurs. The white toner has a larger specific gravity as compared to the color toner. For example, weight per unit area of the color toner layer of each of the respective colors formed on the print medium P is 0.4-0.6 mg/cm2, whereas weight per unit area of the white toner layer is 0.7-1.0 mg/cm2. Therefore, the white toner layer sinks into and mixes with the color toner layer and the phenomenon that the density of the color toner image decreases occurs.

However, in the area where the white toner image and the color toner image are superimposed, not limited to the above phenomenon and regardless of an up-down relation between the toner images, image grade may decrease due to mixing of the white toner and the color toner. For example, during fusion of a toner image, mixing of melted color toner and white toner may occur and the density of the color toner image may decrease.

From a viewpoint of suppressing the above-described decrease in image grade due to mixing of the toners, the controller 60 increases amount of the color toner used to form the color toner image in the case where the white toner image and the color toner image are superimposed and formed on the print medium P as compared to the case where the color toner image is formed on the print medium P without being superimposed with the white toner image. Or, the controller 60 increases the toner amount (or density) of the color toner image formed in an area where the white toner image is formed to be larger than the toner amount (or density) of the color toner image in an area where the white toner image is not formed. For example, the controller 60 increases the toner amount of the color toner image by increasing an area of the color toner image.

Specifically, the controller 60 controls the color image forming parts 10K, 10Y, 10M, 10C in such a manner that the toner amount of the color toner image is increased or the area of the color toner image is increased. More specifically, the controller 60 changes an image forming condition when the color toner image is formed in the color image forming parts 10K, 10Y, 10M, 10C in such a manner that the toner amount of the color toner image is increased or the area of the color toner image is increased. In the present embodiment, the controller 60 changes exposure amount, which is the light quantity from the light source 13 with which the photosensitive drum 11 is irradiated, as the image forming condition. Specifically, the controller 60 increases exposure amount of the light source 13 in each of the color image forming parts 10K, 10Y, 10M, 10C when performing the base printing as compared to performing the ordinary printing and increases a latent image area to increase the area of the color toner image.

In the following, exposure amount control by the controller 60 is described in detail. The controller 60 controls the exposure amount in each of the image forming parts 10K, 10Y, 10M, 10C, 10W based on the image data for each of the K, Y, M, C, W colors. Specifically, the controller 60 increases more the exposure amount for a higher density in the image data.

Figure 6:
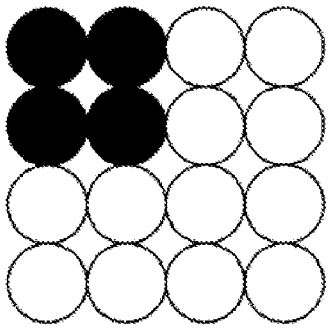
FIG. 6 illustrates an example of an arrangement of latent image dots that configure a unit area.

For each color, the controller 60 controls the exposure amount for each unit area that is configured by N (an integer of 2 or larger) dots of an electrostatic latent image that can be formed on the surface of the photosensitive drum 11. For example, as illustrated in FIG. 6, the controller 60 controls the exposure amount for each unit area that is configured by 16 dots arranged in a shape of a 4×4 matrix. One dot is formed by one LED 13*a* by emitting light once.

The controller 60 controls exposure amount LE in a unit area by controlling a number M of dots that are actually irradiated with light among a number N ($0 \le M \le N$) of dots contained in the unit area and irradiation light quantities li (i=1, 2, . . . , M) that respectively correspond to the M dots. Here, the irradiation light quantity li is the light quantity from the LED 13*a* with which the photosensitive drum 11 is irradiated when forming an i-th dot of the M dots that are actually formed. The controller 60 roughly controls the exposure amount LE by adjusting the number M of the dots and finely controls the exposure amount LE by adjusting the irradiation light quantity li corresponding to each of the dots. The irradiation light quantity li is expressed as $li=L\cdot\alpha i$ using a reference light quantity L that serves as a reference of the exposure amount control and a coefficient $\alpha i$ ($0<\alpha i\le 1$) that indicates a ratio of the irradiation light quantity li with respect to the reference light quantity L. The coefficient $\alpha i$ takes two or more values including 1, and the irradiation light quantity li takes two or more values including the reference light quantity L. The exposure amount LE in a unit area is expressed as a sum of the irradiation light quantities li corresponding to the M dots and is expressed by the following formula (1).

$$LE = l1 + l2 + \ldots + lM \quad (1)$$
$$= L\cdot\alpha 1 + L\cdot\alpha 2 + \ldots + L\cdot\alpha M$$

The controller 60 controls the exposure amount LE by controlling, for example, the number M of the dots and the coefficients $\alpha i$ (i=1, 2, . . . , M) that respectively correspond to the dots.

By controlling the exposure amount LE in a unit area as described above, an exposure area (or latent image area) SE in the unit area is controlled. Further, by controlling the irradiation light quantity li corresponding to each dot, an area si of the each dot is controlled. The area s of one dot becomes larger as the irradiation light quantity 1 becomes larger, and is expressed as a function s(1) of the irradiation light quantity 1. The exposure area SE is expressed by the following formula (2).

$$SE = s1 + s2 + \ldots + sM \quad (2)$$
$$= s(l1) + s(l2) + \ldots + s(lM)$$
$$= s(L\cdot\alpha 1) + s(L\cdot\alpha 2) + \ldots + s(L\cdot\alpha M)$$

Further, by controlling the exposure amount LE in a unit area, an area ratio SR of the dots in the unit area is controlled. The area ratio SR is ratio of a sum of areas of the M dots that are actually formed (that is, the exposure area SE) with respect to a sum of areas of the N dots when all the N dots in a unit area are formed with the reference light quantity L. When an area s(L) of a dot formed with the reference light quantity L is S, the area ratio SR is expressed by the following formula (3).

$$SR=\{SE/(N\cdot S)\}\cdot 100(\%) \quad (3)$$

In FIG. 6, black circles represent dots that are actually formed and white circles represent dots that are not actually formed. When one dot of the 16 dots is formed with the reference light quantity L, the area ratio SR is 6.25%. In an example of FIG. 6, four dots are formed with the reference light quantity L so that the area ratio SR is 6.25×4=25%. By adjusting the irradiation light quantity to be less than the reference light quantity L, a size of a dot (to put it simply, a size of a black circle in FIG. 6) can be reduced and the area ratio SR can be finely adjusted.

In the ordinary printing, the controller 60 uses light quantity L0 as the reference light quantity L. On the other hand, in the base printing, as compared to the ordinary printing, the controller 60 increases the reference light quantity L corresponding to the K, Y, M, C colors. Specifically, the controller 60 corrects the light quantity L0 using a correction coefficient $\Delta L$ (>1) and uses $L0\cdot\Delta L$ as the reference light quantity L. For the W color, the controller 60 uses as the reference light quantity L the light quantity L0 that is the same as when performing the ordinary printing.

By the above correction control, in the base printing, as compared to when performing the ordinary printing, the irradiation light quantity for each dot of the K, Y, M, C colors is increased (specifically, increased by $\Delta L$ times) and the area of each dot is increased. As a result, the exposure amount LE increases and the exposure area SE increases.

The controller 60 respectively independently controls the exposure amounts of the light sources 13K, 13Y, 13M, 13C, 13W. In this case, the light quantity L0 may be a difference value for each color. For example, light quantities Lk, Ly, Lm, Lc, Lw are respectively used as the light quantities L0 of the K, Y, M, C, W colors.

In the present example, the controller 60 controls the irradiation light quantity li by controlling light emitting time (or ON time) of the LED 13*a*. Specifically, assuming the light emitting time of the LED 13*a* required to obtain the light quantity L0 is T0, in the ordinary printing, when a dot is formed with the reference light quantity L (=L0), the LED 13*a* is caused to emit light for the light emitting time T0, and when a dot is formed with the light quantity L0·αi, the LED 13*a* is caused to emit light for the light emitting time T0·αi. In the base printing, when a dot is formed with the reference light quantity L (=L0·ΔL), the LED 13*a* is caused to emit light for the light emitting time T0·ΔL, and when a dot is formed with the light quantity L0·ΔL·αi, the LED 13*a* is caused to emit light for the light emitting time T0·ΔL·αi. For example, when the reference light quantity L is multiplied by 1.1, 1.2, . . . using ΔL, the controller 60 multiplies the light emitting time of one LED 13*a* for emitting light once by 1.1, 1.2, . . . .

Figure 7:
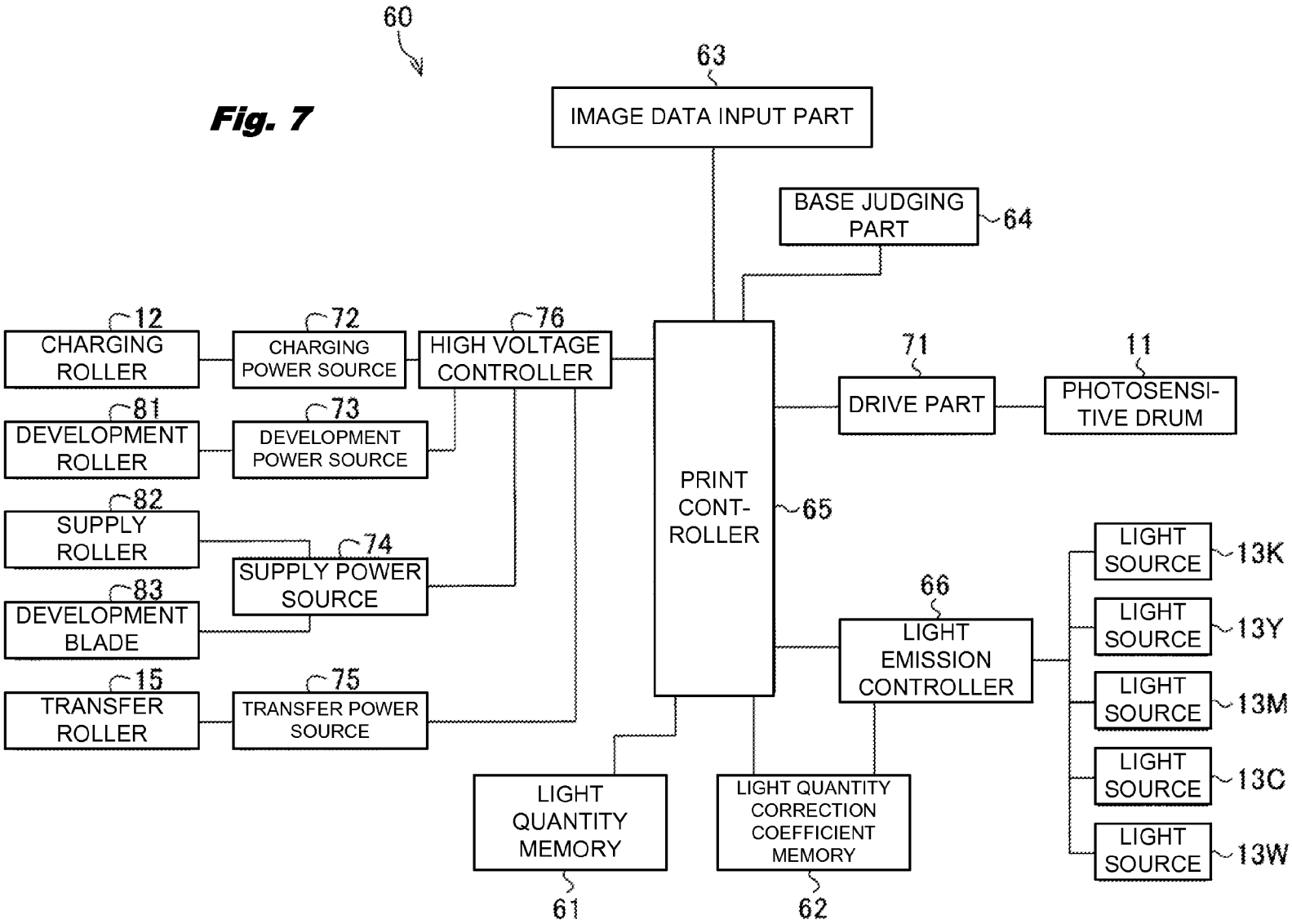
FIG. 7 illustrates a block diagram of an example of a configuration of a controller in a first embodiment.

FIG. 7 illustrates a block diagram of an example of a configuration of the controller 60. In the following, with reference to FIG. 7, a specific configuration example of the controller 60 is described.

In FIG. 7, the controller 60 has a light quantity memory 61, a light quantity correction coefficient memory 62, an image data input part 63, a base judgment part 64, a print controller 65 and a light emission controller 66.

The light quantity memory 61 stores the light quantities Lk, Ly, Lm, Lc, Lw that are the reference light quantities of the K, Y, M, C, W colors when performing the ordinary printing. The light quantity correction coefficient memory 62 stores the correction coefficient ΔL that is used to correct the reference light quantities when performing the base printing.

The image data input part 63 receives input of image data of a print target from a host device (not illustrated in the drawings) and the like and sent the image data to the print controller 65. The image data includes a base setting value indicating ON/OFF of a base (or white background).

The base judgment part 64 judges whether or not the image data sent from the image data input part 63 to the print controller 65 is image data to be base-printed and notifies the print controller 65 of a judgment result. Specifically, the base judgment part 64 notifies the print controller 65 of base ON when the base setting value of the image data is ON and notifies the print controller 65 of base OFF when the base setting value is OFF.

The print controller 65 controls each part of the image forming apparatus 100 based on the image data from the image data input part 63 and the judgment result from the base judgment part 64 and prints an image corresponding to the image data on the print medium P. The print controller 65 performs the ordinary printing when the judgment result is base OFF and performs the base printing when the judgment result is base ON.

In print control, the print controller 65 sends the input image data to the light emission controller 66. In this case, the print controller 65 may convert the input image data into image data of respective colors for light emission control and send the converted image data. The image data of respective colors for light emission control is, for example, bitmap data representing gradation values of dots of an electrostatic latent image. For example, the gradation value of each dot is set to be the coefficient αi ($0<\alpha i\leq 1$) for a dot that is actually formed and 0 for a dot that is not actually formed.

In the case of base OFF, the print controller 65 obtains the light quantities Lk, Ly, Lm, Lc, Lw that are stored in the light quantity memory 61 and sends the light quantities Lk, Ly, Lm, Lc, Lw to the light emission controller 66.

In the case of base ON, the print controller 65 obtains the light quantities Lk, Ly, Lm, Lc, Lw that are stored in the light quantity memory 61 and the correction coefficient ΔL that is stored in the light quantity correction coefficient memory 62 and sends light quantities Lk·ΔL, Ly·ΔL, Lm·ΔL, Lc·ΔL, Lw to the light emission controller 66. Further, the print controller 65 sends base image data representing a base image that is prepared in advance to the light emission controller 66. For example, the base image data is image data of an entire-surface solid image for which the gradation values of all dots are set to be αi=1.

The light emission controller 66 controls light emission of the light source 13 of each color based on the image data of the each color from the print controller 65 and forms an electrostatic latent image on the surface of the photosensitive drum 11 of the each color.

Specifically, in the case of base OFF, the light emission controller 66 respectively uses the light quantities Lk, Ly, Lm, Lc as the reference light quantity L to form electrostatic latent images corresponding to the image data of the K, Y, M, C colors on the photosensitive drums 11K, 11Y, 11M, 11C. Further, the light emission controller 66 may also use the light quantity Lw as the reference light quantity L to form an electrostatic latent image corresponding to the image data of the W color on the photosensitive drum 11W.

In the case of base ON, the light emission controller 66 respectively uses the light quantities Lk·ΔL, Ly·ΔL, Lm·ΔL, Lc·ΔL as the reference light quantity L to form electrostatic latent images corresponding to the image data of the K, Y, M, C colors on the photosensitive drums 11K, 11Y, 11M, 11C. Further, the light emission controller 66 uses the light quantity Lw as the reference light quantity L to form an electrostatic latent image corresponding to the base image data on the photosensitive drum 11W.

In FIG. 7, the controller 60 further has a drive part 71, a charging power source 72, a development power source 73, a supply power source 74, a transfer power source 75 and a high voltage controller 76.

The drive part 71 is, for example, a motor, and drives and rotates the photosensitive drum 11 and the like according to an instruction from the print controller 65. The charging power source 72 is a power source that applies a charging voltage Vch to the charging roller 12. The development power source 73 is a power source that applies a development voltage Vd to the development roller 81. The supply power source 74 is a power source that applies the supply voltage Vs to the supply roller 82 and the development blade 83. The transfer power source 75 is a power source that applies a transfer voltage Vt to the transfer roller 15. The high voltage controller 76, according to an instruction from the print controller 65, controls the charging power source 72, the development power source 73, the supply power source 74 and the transfer power source 75 to respectively apply biases to the charging roller 12, the development roller 81, the supply roller 82 and the development blade 83, and the transfer roller 15.

[Operations of Image Forming Apparatus]

In the following, printing operations of the image forming apparatus 100 are described. The print controller 65, upon receiving input of image data from the image data input part 63, controls each part of the image forming apparatus 100 in such a manner that the following printing operations are performed.

Referring to FIG. 1, the rollers on the carrying route A are driven by the drive part 71; and the print medium P that is stacked in the print medium tray 21 is separated and brought out one by one by the hopping roller 22 and, after a leading edge position is aligned by the registration roller 23, is carried by the carrying roller 25 to the carrying belt 30. The print medium P is carried by the carrying belt 30 and sequentially passes through the image forming parts 10K, 10Y, 10M, 10C, 10W. In this case, toner images of the K, Y, M, C, W colors are formed in this order on the print medium P. The print medium P onto which the toner images are transferred is carried by the carrying belt 30 to the fuser device 40. The toner images on the print medium P are heated and pressed by the fuser device 40 are fused on the print medium P. Thereafter, the print medium P is ejected by the ejection roller 51 to the stacker part 53.

Next, among the above printing operations, a formation operation of a toner image by the image forming part 10K is described. Operations of the image forming parts 10Y, 10M, 10C, 10W are the same as that of the image forming part 10K and thus their description is omitted.

The photosensitive drum 11 rotates due to a drive force from the drive part 71 with respect to the photosensitive gear. The charging roller 12 rotates due to being driven in association with the rotation of the photosensitive drum 11, and the development roller 81 and the supply roller 82 are rotationally driven due to a drive force from the photosensitive gear. The charging voltage Vch from the charging power source 72 is applied to the charging roller 12 and the surface of the photosensitive drum 11 is negatively charged. The surface of the charged photosensitive drum 11 is irradiated with light from the light source 13, the light being corresponding to the image data. Of the surface of the photosensitive drum 11, a portion that is irradiated with light has a potential that is lowered according to an exposure amount radiated from the light source 13 and thereby an electrostatic latent image is formed on the surface of the photosensitive drum 11. In this case, of the surface of the photosensitive drum 11, an exposed portion that is fully exposed (irradiated with the reference light quantity L) has a potential in a range from −30 to 90 V and an unexposed portion that is not exposed has a potential in a range from −400 to −550 V. In the development device 14, the supply roller 82 rotates in the same direction (counterclockwise) as the development roller 81. Thereby, the toner is negatively charged by friction and is carried from the supply roller 82 to the development roller 81. Further, the development voltage Vd (in this case, in a range from −100 to −300 V) is applied from the development power source 73 to the development roller 81 and the supply voltage Vs is applied from the supply power source 74 to the supply roller 82 and the development blade 83. Due to a potential difference between the development roller 81 and the supply roller 82, the toner is supplied from the supply roller 82 to the development roller 81. Further, due to a potential difference between the development roller 81 and the development blade 83, a thickness of a toner layer on the development roller 81 is regulated and, due to the L-shaped shape of the development blade 83, excessive toner on the development roller 81 is scraped off and a uniform toner layer is formed on the development roller 81. Due to a potential difference between the development roller 81 and the photosensitive drum 11, the toner of the toner layer that is formed on the development roller 81 is supplied to the electrostatic latent image on the photosensitive drum 11 and a toner image is formed on the photosensitive drum 11. In this case, the toner selectively adheres to a portion of the surface of the photosensitive drum 11 where a surface potential is lowered by being irradiated with light from the light source 13. The print medium P is carried by the carrying belt 30 to the photosensitive drum 11. During a time period in which the photosensitive drum 11 and the print medium P are in contact with each other, the transfer voltage Vt is applied from the transfer power source 75 to the transfer roller 15 and the toner image that is formed on the photosensitive drum 11 is transferred onto the print medium P. When the transfer of the toner image onto the print medium P is completed, the rotation of the photosensitive drum 11 due to the drive part 71 stops, and application of voltages from the power sources to the respective members stops.

FIG. 8 illustrates a flow diagram illustrating steps of exposure control. In the following, with reference to FIG. 8, exposure control of the above printing operations is described.

At S11, the print controller 65 receives input of image data from the image data input part 63 and proceeds to S12. The image data includes image data of the K, Y, M, C colors and a base setting value.

At S12, the print controller 65 sends the input image data to the base judgment part 64, receives from the base judgment part 64 a judgment result indicating base ON or base OFF, and proceeds to S13 in the case of base OFF and S15 in the case of base ON.

At S13, the print controller 65 reads the light quantities Lk, Ly, Lm, Lc, Lw from light quantity memory 61, and proceeds to S14.

At S14, the print controller 65 controls the light emission controller 66 to form electrostatic latent images on the photosensitive drums 11K, 11Y, 11M, 11C by using the light quantities Lk, Ly, Lm, Lc obtained at S13 as the reference light quantity L and respectively causing the light sources 13K, 13Y, 13M, 13C to radiate light corresponding to the image data of the K, Y, M, C colors. When the input image data includes image data of the W color, the print controller 65 may also form an electrostatic latent image on the photosensitive drum 11W by using the light quantity Lw as the reference light quantity L and causing the light source 13W to radiate light corresponding to the image data of the W color. When the formation of the electrostatic latent images is completed, the process terminates.

At S15, the print controller 65 reads the light quantities Lk, Ly, Lm, Lc, Lw from the light quantity memory 61, reads the correction coefficient ΔL from the light quantity correction coefficient memory 62, calculates corrected light quantities Lk·ΔL, Ly·ΔL, Lm·ΔL, Lc·ΔL, and proceeds to S16.

At S16, the print controller 65 controls the light emission controller 66 to form electrostatic latent images on the photosensitive drums 11K, 11Y, 11M, 11C by using the corrected light quantities Lk·ΔL, Ly·ΔL, Lm·ΔL, Lc·ΔL obtained at S15 as the reference light quantity L and respectively causing the light sources 13K, 13Y, 13M, 13C to radiate light corresponding to the image data of the K, Y, M, C colors. Further, the print controller 65 controls the light emission controller 66 to form an electrostatic latent image of a base image on the photosensitive drum 11W by using the light quantity Lw as the reference light quantity L and causing the light source 13W to radiate light corresponding to the base image data. When the formation of the electrostatic latent images is completed, the process terminates.

[Evaluation Results] In the following, results of evaluation performed using the above image forming apparatus 100 are illustrated. In the present evaluation, under various conditions, a halftone image of the cyan (C) color that was gradation-expressed by dot formation was printed and a toner dot diameter ϕ in the print image was measured. Specifically, measurements of a reference example 1, a comparative example 1 and examples 1-4 were performed under the following conditions.

Reference example 1: base OFF, reference light quantity L=Lc

Comparative example 1: base ON, reference light quantity L=Lc

Example 1: base ON, reference light quantity L=Lc×1.1

Example 2: base ON, reference light quantity L=Lc×1.2

Example 3: base ON, reference light quantity L=Lc×1.3

Example 4: base ON, reference light quantity L=Lc×1.4

Figure 9A:
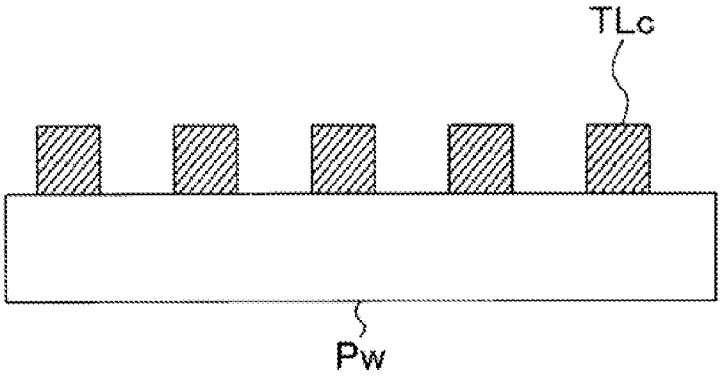
FIGS. 9A and 9B respectively illustrate a plan view and a cross-sectional view of a cyan toner image in an example of base OFF.
Figure 9B:
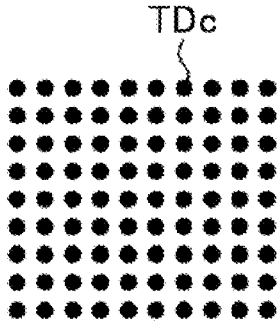

FIGS. 9A and 9B respectively illustrate a plan view and a cross-sectional view of a cyan toner image in an example of base OFF (reference example 1). In the example of base OFF, as illustrated in FIG. 9A, a cyan toner layer TLc was formed on a white paper medium Pw as a print medium; and, as illustrated in FIG. 9B, a plurality of toner dots TDc arranged in a matrix shape were formed.

Figure 10A:
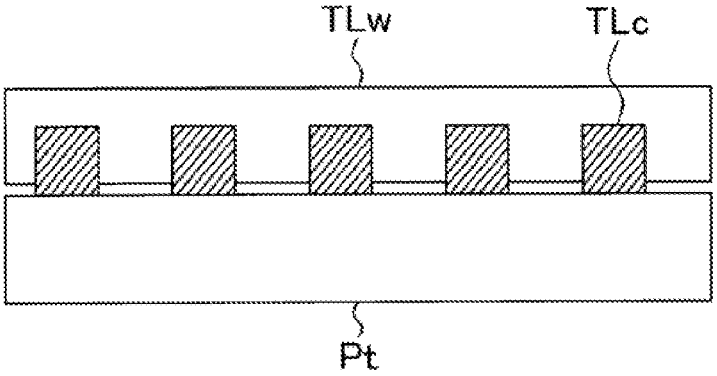
Figure 10B:
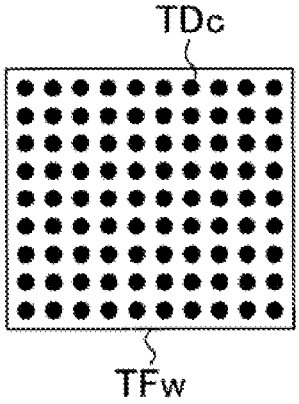

FIGS. 10A and 10B respectively illustrate a plan view and a cross-sectional view of a cyan toner image in an example of base ON (comparative example 1, examples 1-4). In the example of base ON, as illustrated in FIG. 10A, a cyan toner layer TLc was formed on a white paper medium Pw as a print medium and a white toner layer TLw was superimposed on the cyan toner layer TLc; and, as illustrated FIG. 10B, a plurality of toner dots TDc arranged in a matrix shape were formed and a white base TFw was formed.

In each of the above examples, four kinds of halftone images of different gradations for which the area ratios SR were respectively 10%, 20%, 30% and 40% were printed.

FIGS. 11A, 11B, 11C and 11D respectively illustrate dot patterns of unit areas of electrostatic latent images corresponding to area ratios of 10%, 20%, 30% and 40%. Similar to FIG. 6, the unit area of an electrostatic latent image was configured by 4×4=16 dots. When one of the 16 dots was formed with the reference light quantity L, the area ratio was 6.25%.

Figure 11D:
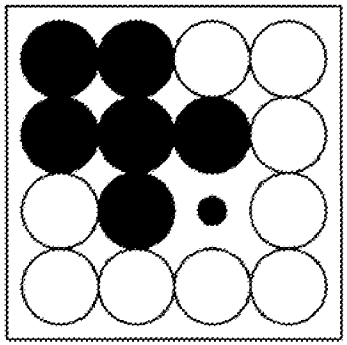
FIGS. 11A, 11B, 11C and 11D respectively illustrate dot patterns of unit areas of electrostatic latent images.
Figure 11C:
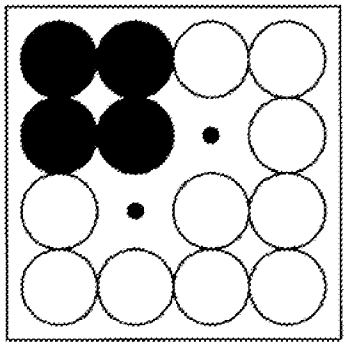
Figure 11B:
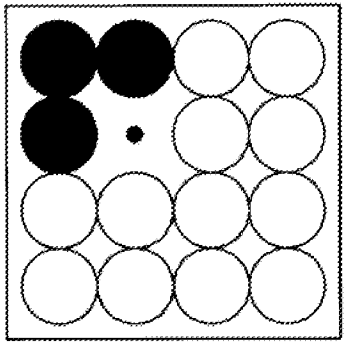
Figure 11A:
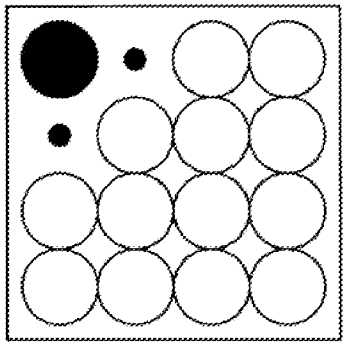

As illustrated in FIG. 11A, the pattern of the case where the area ratio was 10% includes one dot formed with the reference light quantity L (having an area ratio of 6.25%) and two dots formed with an irradiation light quantity smaller than the reference light quantity L (each of the two dots having an area ratio of 1.875%).

As illustrated in FIG. 11B, the pattern of the case where the area ratio was 20% includes three dots formed with the reference light quantity L (each of the three dots having an area ratio of 6.25%) and one dot formed with an irradiation light quantity smaller than the reference light quantity L (having an area ratio of 1.25%).

As illustrated in FIG. 11C, the pattern of the case where the area ratio was 30% includes four dots formed with the reference light quantity L (each of the four dots having an area ratio of 6.25%) and two dots formed with an irradiation light quantity smaller than the reference light quantity L (each of the two dots having an area ratio of 1.25%).

As illustrated in FIG. 11D, the pattern of the case where the area ratio was 40% includes six dots formed with the reference light quantity L (each of the six dots having an area ratio of 6.25%) and one dot formed with an irradiation light quantity smaller than the reference light quantity L (having an area ratio of 5%).

In any one of the above patterns, the plurality of the dots of the electrostatic latent image are arranged adjacent to each other and form one toner dot TDc by being developed with the cyan toner.

In each of the above examples, the dot diameter ϕ of the toner dot TDc on the print medium after printing was measured using a dot tool of a handy-type image evaluation system Pias-II (manufactured by QEA). Table 1 illustrates print conditions and measurement results of the reference example 1, the comparative example 1 and the examples 1-4.

TABLE 1

| | Reference | | Dot Diameter ϕ | | | |
|---|---|---|---|---|---|---|
| | Light Quantity L | Base | Area Ratio: 10% | Area Ratio: 20% | Area Ratio: 30% | Area Ratio: 40% |
| Reference Example 1 | Lc | OFF | 56 μm | 84 μm | 104 μm | 127 μm |
| Comparative Example 1 | Lc | ON | 45 μm<br>X | 66 μm<br>X | 84 μm<br>X | 99 μm<br>X |
| Example 1 | Lc × 1.1 (ΔL = 1.1) | ON | 49 μm<br>X | 73 μm<br>X | 91 μm<br>X | 108 μm<br>X |
| Example 2 | Lc × 1.2 (ΔL = 1.2) | ON | 53 μm<br>○ | 79 μm<br>○ | 101 μm<br>○ | 119 μm<br>○ |
| Example 3 | Lc × 1.3 (ΔL = 1.3) | ON | 57 μm<br>○ | 86 μm<br>○ | 109 μm<br>○ | 131 μm<br>○ |
| Example 4 | Lc × 1.4 (ΔL = 1.4) | ON | 60 μm<br>○ | 93 μm<br>X | 119 μm<br>X | 144 μm<br>X |

In the case where the base is ON, it is desirable that an image having a density that is about the same as in the case of base OFF is obtained, and it is desirable that a dot diameter ϕ about the same as in the case where the base is OFF is obtained. Therefore, an image of the reference example 1 was used as a reference to evaluate images of the comparative example 1 and the examples 1-4. Specifically, dot diameters ϕ of the cases where the base was ON were evaluated using a range within ±10% of the dot diameter ϕ of the reference example 1 as a range of good dot diameters ϕ, within which a density difference with the case where the base was OFF was not felt. In Table 1, dot diameters ϕ that were judged to be good are assigned circle marks (○) and other dot diameters ϕ are assigned cross marks (x).

Comparing the reference example 1 and the comparative example 1, in the comparative example 1 in which printing is performed with base ON without performing the correction control of the exposure amount, the dot diameters are smaller by 18-20% with respect to the reference example 1 in which printing is performed with base OFF.

Comparing the comparative example 1 and the examples 1-4, in the examples 1-4 in which the correction control of the exposure amount was performed, the dot diameters are larger with respect to the comparative example 1 in which the correction control is not performed.

Comparing the reference example 1 and the example 1, in the example 1 in which the correction was performed with the correction coefficient ΔL=1.1, the dot diameters are smaller by 11-13% with respect to the reference example 1 and the images are judged as being in light color shades.

Comparing the reference example 1 and the examples 2 and 3, in the examples 2 and 3 in which the correction is performed with the correction coefficient ΔL=1.2, 1.3, the dot diameters are within a range from −6 to +5% with respect to the reference example 1 and the images are judged as being good images for which a density difference is not felt.

Comparing the reference example 1 and the example 4, in the example 4 in which the correction was performed with the correction coefficient ΔL=1.4, the dot diameters are larger by 7-14% with respect to the reference example 1 and the images formed under conditions other than that of the area ratio of 10% are judged as being in dark color shades.

Based on the above evaluation results, it is preferable that, when a white toner image and a color toner image are superimposed and formed (for example, when performing the base printing), the exposure amount in a color image forming part is increased 1.2-1.3 times as compared to when a color toner image is formed without being superimposed with a white toner image (for example, when performing the ordinary printing). For example, it is preferable that, when performing the correction control in which the exposure amount (specifically, the reference light quantity) is increased by ΔL times, the correction coefficient ΔL is set to be in a range of 1.2-1.3.

[Effects] As described above, in the present embodiment, in the case where a first developer image that represents an image and a second developer image that serves as a base of the first developer image are superimposed and formed on an image-formed body, the image forming apparatus increases the amount of a first developer used to form the first developer image as compared to the case where the first developer image is formed on the image-formed body without being superimposed with the second developer image. Therefore, in the case where a developer image that represents an image and a developer image that serves as a base of the image are superimposed and formed on an image-formed body, a decrease in image grade, such as a decrease in image density due to the developer image that serves as a base, can be suppressed and a good image can be obtained. Further, in the present embodiment, in the case where a color first developer image and a while second developer image are superimposed and formed on an image-formed body, the image forming apparatus increases the amount of a first developer used to form the first developer image as compared to the case where the first developer image is formed on the image-formed body without being superimposed with the second developer image. Therefore, in the case where a color developer image and a white developer image are superimposed and formed on an image-formed body, a decrease in image quality, such as a decrease in image density due to the white developer image, can be suppressed and a good image can be obtained. Specifically, in the case where a white toner image and a color toner image are superimposed and formed on an image-formed body, as compared to the case where the color toner image is formed on the image-formed body without being superimposed with the white toner image, the toner amount of the color toner image is increased. Thereby, even when the color toner and the white toner mix, a sufficient density or a density corresponding to the image data can be ensured and a decrease in the density of the color toner image can be suppressed.

Second Embodiment

In the following, an image forming apparatus of a second embodiment is described. For the image forming apparatus in the second embodiment, as compared to the above first embodiment, the configuration of the controller 60 is different, and other parts are the same. In the following description, a portion that is the same as for the first embodiment is omitted or simplified, and an element that is the same as or corresponding to that in the first embodiment is indicated using the same reference numeral symbol.

In the present embodiment, in the case where an image forming condition is changed when forming a color toner image in the color image forming parts 10K, 10Y, 10M, 10C, as the image forming condition, instead of or in addition to changing the exposure amount of the light source 13, the controller 60 changes the potential difference between the photosensitive drum 11 and the development roller 81. Specifically, the controller 60 changes the development voltage Vd applied to the development roller 81. In the present example, the controller 60 increases the toner amount of the color toner image by increasing an absolute value of the development voltage Vd applied to the development roller 81.

Figure 12:
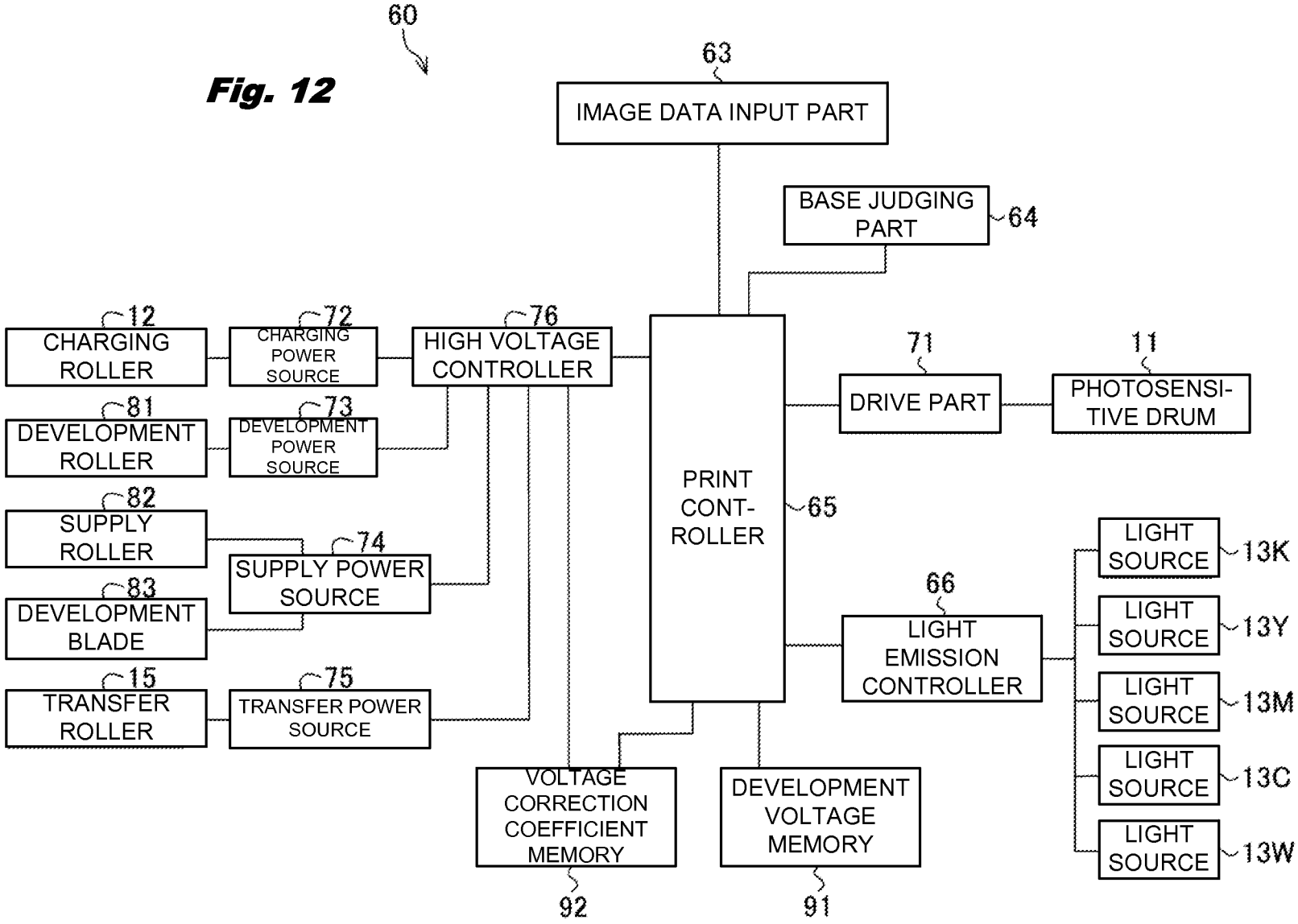
FIG. 12 illustrates a block diagram of an example of a configuration of a controller in a second embodiment.

FIG. 12 illustrates a block diagram of an example of a configuration of the controller 60 in the second embodiment. In the following, with reference to FIG. 12, a specific configuration example of the controller 60 in the second embodiment is described.

In FIG. 12, the controller 60 has a development voltage memory 91, a voltage correction coefficient memory 92, the image data input part 63, the base judgment part 64, the print controller 65, the light emission controller 66 and the high voltage controller 76.

The development voltage memory 91 stores voltages Vk, Vy, Vm, Vc, Vw that are the development voltages Vd of the K, Y, M, C, W colors when performing the ordinary printing. The development voltages Vd of the respective colors are each independently controlled and the voltages Vk, Vy, Vm, Vc, Vw may be different from each other.

The voltage correction coefficient memory 92 stores a correction coefficient ΔV (>1) that is used to correct the development voltage Vd when performing the base printing.

The image data input part 63, similar to that in the first embodiment, sends input image data to the print controller 65. The base judgment part 64, similar to that in the first embodiment, notifies the print controller 65 of a judgment result of base ON/OFF.

The print controller 65 controls each part of the image forming apparatus 100 based on the image data from the image data input part 63 and the judgment result from the base judgment part 64 and prints an image corresponding to the image data on the print medium P. The print controller 65 performs the ordinary printing when the judgment result is base OFF and performs the base printing when the judgment result is base ON.

In print control, the print controller 65, similar to that in the first embodiment, sends image data of the respective colors to the light emission controller 66 and, in the case of base ON, further sends base image data of the W color to the light emission controller 66.

In the case of base OFF, the print controller 65 obtains the voltages Vk, Vy, Vm, Vc, Vw stored in the development voltage memory 91 and sends the voltages Vk, Vy, Vm, Vc, Vw to the high voltage controller 76.

In the case of base ON, the print controller 65 obtains the voltages Vk, Vy, Vm, Vc, Vw stored in the development voltage memory 91 and the correction coefficient ΔV stored in the voltage correction coefficient memory 92, and sends voltages Vk·ΔV, Vy·ΔV, Vm·ΔV, Vc·ΔV, Vw to the high voltage controller 76.

The light emission controller 66, similar to that in the first embodiment, controls light emission of the light source 13 of each color based on the image data of the each color and forms an electrostatic latent image on the surface of the photosensitive drum 11 of the each color. However, in the present embodiment, the correction control of the exposure amount is not performed.

The high voltage controller 76, according to an instruction from the print controller 65, controls the charging power source 72, the development power source 73, the supply power source 74 and the transfer power source 75 to respectively apply biases to the charging roller 12, the development roller 81, the supply roller 82 and the development blade 83, and the transfer roller 15.

In the case of base OFF, the high voltage controller 76 respectively applies the voltages Vk, Vy, Vm, Vc as the development voltage Vd to the development rollers 81K, 81Y, 81M, 81C. Further, the high voltage controller 76 may also apply the voltage Vw as the development voltage Vd to the development roller 81W.

In the case of base ON, the high voltage controller 76 respectively applies the voltages Vk·ΔV, Vy·ΔV, Vm·ΔV, Vc·ΔV, Vw as the development voltage Vd to the development rollers 81K, 81Y, 81M, 81C, 81W of the respective colors.

In FIG. 12, the controller 60 further has the drive part 71, the charging power source 72, the development power source 73, the supply power source 74 and the transfer power source 75. These parts are the same as in the first embodiment.

FIG. 13 illustrates a flow diagram illustrating steps of development voltage control in the second embodiment. In the following, with reference to FIG. 13, the development voltage control is described.

At S21, the print controller 65 receives input of image data from the image data input part 63 and proceeds to S22. The image data includes image data of the K, Y, M, C colors and a base setting value.

At S22, the print controller 65 sends the input image data to the base judgment part 64, receives from the base judgment part 64 a judgment result indicating base ON or base OFF, and proceeds to S23 in the case of base OFF and S25 in the case of base ON.

At S23, the print controller 65 reads the voltages Vk, Vy, Vm, Vc, Vw from the development voltage memory 91, and proceeds to S24.

At S24, the print controller 65 controls the high voltage controller 76 to form toner images of the K, Y, M, C colors by respectively applying the voltages Vk, Vy, Vm, Vc obtained at S23 as the development voltage Vd to the development rollers 81K, 81Y, 81M, 81C. When the input image data includes image data of the W color, the print controller 65 may also form a toner image of the W color by applying the voltage Vw as the development voltage Vd to the development roller 81W. When the formation of the toner image is completed, the process terminates.

At S25, the print controller 65 reads the voltages Vk, Vy, Vm, Vc, Vw from the development voltage memory 91 and the correction coefficient ΔV from the voltage correction coefficient memory 92, calculates corrected development voltages Vk·ΔV, Vy·ΔV, Vm·ΔV, Vc·ΔV, and proceeds to S26.

At S26, the print controller 65 controls the high voltage controller 76 to form toner images of the K, Y, M, C colors by respectively applying the corrected development voltages Vk·ΔV, Vy·ΔV, Vm·ΔV, Vc·ΔV obtained at S25 as the development voltage Vd to the development rollers 81K, 81Y, 81M, 81C. Further, the print controller 65 applies the voltage Vw as the development voltage Vd to the development roller 81W to form a toner image of the W color as a base layer. When the formation of the toner image is completed, the process terminates.

In the following, results of evaluation performed using the above image forming apparatus of the second embodiment are illustrated. In the present evaluation, under various conditions, a halftone image of the cyan (C) color that was gradation-expressed by dot formation was printed and a toner dot diameter ϕ in the print image was measured. Specifically, measurements of a reference example 2, a comparative example 2 and examples 5-9 were performed under the following conditions.

Reference example 2: base OFF, development voltage Vd=Vc

Comparative example 2: base ON, development voltage Vd=Vc

Example 5: base ON, development voltage Vd=Vc×1.1

Example 6: base ON, development voltage Vd=Vc×1.2

Example 7: base ON, development voltage Vd=Vc×1.3

Example 8: base ON, development voltage Vd=Vc×1.4

Example 9: base ON, development voltage Vd=Vc×1.5

Similar to the first embodiment, in an example of base OFF, as illustrated in FIG. 9A, a cyan toner layer TLc was formed on a paper medium Pw; and as illustrated in FIG. 9B, a plurality of toner dots TDc were formed. Further, in an example of base ON, as illustrated in FIG. 10A, a cyan toner layer TLc was formed on a transparent film Pt and a white toner layer TLw was superimposed on the cyan toner layer TLc; and, as illustrated FIG. 10B, a plurality of toner dots TDc were formed and a white base TFw was formed.

Further, similar to the first embodiment, in each of the above examples, four kinds of halftone images of different gradations for which the area ratios SR were respectively 10%, 20%, 30% and 40% were printed, and dot diameters ϕ of toner dots TDc on the print medium after printing were measured. Table 2 illustrates print conditions and measurement results of the reference example 2, the comparative example 2 and the examples 5-9.

TABLE 2

| | | | Dot Diameter ϕ | | | |
|---|---|---|---|---|---|---|
| | Development Voltage Vd | Base | Area Ratio: 10% | Area Ratio: 20% | Area Ratio: 30% | Area Ratio: 40% |
| Reference Example 2 | Vc | OFF | 56 μm | 84 μm | 104 μm | 127 μm |
| Comparative Example 2 | Vc | ON | 45 μm<br>X | 66 μm<br>X | 84 μm<br>X | 99 μm<br>X |
| Example 5 | Vc × 1.1<br>(ΔV = 1.1) | ON | 48 μm<br>X | 71 μm<br>X | 89 μm<br>X | 108 μm<br>X |
| Example 6 | Vc × 1.2<br>(ΔV = 1.2) | ON | 51 μm<br>○ | 77 μm<br>○ | 95 μm<br>○ | 118 μm<br>○ |
| Example 7 | Vc × 1.3<br>(ΔV = 1.3) | ON | 54 μm<br>○ | 82 μm<br>○ | 102 μm<br>○ | 124 μm<br>○ |

TABLE 2-continued

| | Development Voltage Vd | Base | Dot Diameter ϕ Area Ratio: 10% | Area Ratio: 20% | Area Ratio: 30% | Area Ratio: 40% |
|---|---|---|---|---|---|---|
| Example 8 | Vc × 1.4 (ΔV = 1.4) | ON | 57 μm ○ | 88 μm ○ | 109 μm ○ | 131 μm ○ |
| Example 9 | Vc × 1.5 (ΔV = 1.5) | ON | 61 μm ○ | 93 μm X | 118 μm X | 140 μm X |

An image of the reference example 2 was used as a reference to evaluate images of the comparative example 2 and the examples 5-9. Specifically, dot diameters ϕ where the base was ON were evaluated using a range within ±10% of the dot diameter ϕ of the reference example 2 as a range of good dot diameters ϕ, within which a density difference with the case of base OFF was not felt. In Table 2, dot diameters ϕ that were judged to be good are assigned circle marks and other dot diameters ϕ are assigned cross marks.

Comparing the reference example 2 and the comparative example 2, in the comparative example 2 in which printing was performed with base ON without performing the correction control of the development voltage, the dot diameters are smaller by 18-20% with respect to the reference example 2 in which printing is performed with base OFF.

Comparing the comparative example 2 and the examples 5-9, in the examples 5-9 in which the correction control of the development voltage was performed, the dot diameters are larger with respect to the comparative example 2 in which the correction control is not performed.

Comparing the reference example 2 and the example 5, in the example 5 in which the correction is performed with the correction coefficient ΔV=1.1, the dot diameters are smaller by 14-15% with respect to the reference example 2 and the images are judged as being in light color shades.

Comparing the reference example 2 and the examples 6-8, in the examples 6-8 in which the correction was performed with the correction coefficient ΔV=1.2-1.4, the dot diameters are within a range from −9 to +5% with respect to the reference example 2 and the images are judged as being good images for which a density difference is not felt.

Comparing the reference example 2 and the example 9, in the example 9 in which the correction was performed with the correction coefficient ΔV=1.5, the dot diameters are larger by 9-13% with respect to the reference example 2 and the images formed under conditions other than that of the area ratio of 10% are judged as being in dark color shades.

Based on the above evaluation results, it is preferable that, when a white toner image and a color toner image are superimposed and formed (for example, when performing the base printing), the development voltage in a color image forming part is increased 1.2-1.4 times as compared to when a color toner image is formed without being superimposed with a white toner image (for example, when performing the ordinary printing). For example, it is preferable that, when performing the correction control in which the development voltage is increased by ΔV times, the correction coefficient ΔV is set to be in a range of 1.2-1.4.

As described above, in the present embodiment, in the case where a white toner image and a color toner image are superimposed and formed on an image-formed body, the image forming apparatus changes a voltage applied to a developer carrier in a manner that an amount of a color toner used to form a color toner image is increased as compared to the case where the color toner image is formed on the image-formed body without being superimposed with the white toner image. Therefore, according to the present embodiment, a good image can be obtained in the case where a white toner image and a color toner image are superimposed and formed on an image-formed body.

Specifically, by changing the setting of the development voltage, a toner adhesion area (for example, a dot diameter) and a toner layer thickness on the surface of the photosensitive drum 11 and can be changed and a toner adhesion amount on the photosensitive drum 11 can be changed. Specifically, by increasing the absolute value of the development voltage, the potential difference between an exposed portion of the surface of the photosensitive drum 11 and the development roller 81 is increased so that the toner adhesion area and layer thickness are increased and the toner adhesion amount is increased. The reason for this is as follows. An absolute value of the potential on the surface of the photosensitive drum after exposure is higher at a position more distanced away from an exposure center. Therefore, the toner is less likely to adhere with increasing distance from the exposure center. By increasing the absolute value of the development voltage, even at a position distanced away from the exposure center, the toner is likely to adhere and thus the dot diameter of the toner increases. Further, when the absolute value of the development voltage is increased, the potential difference between the exposed portion of the photosensitive drum 11 and the development roller 81 is enlarged and thus the toner layer thickness is increased.

Third Embodiment

Figure 14:
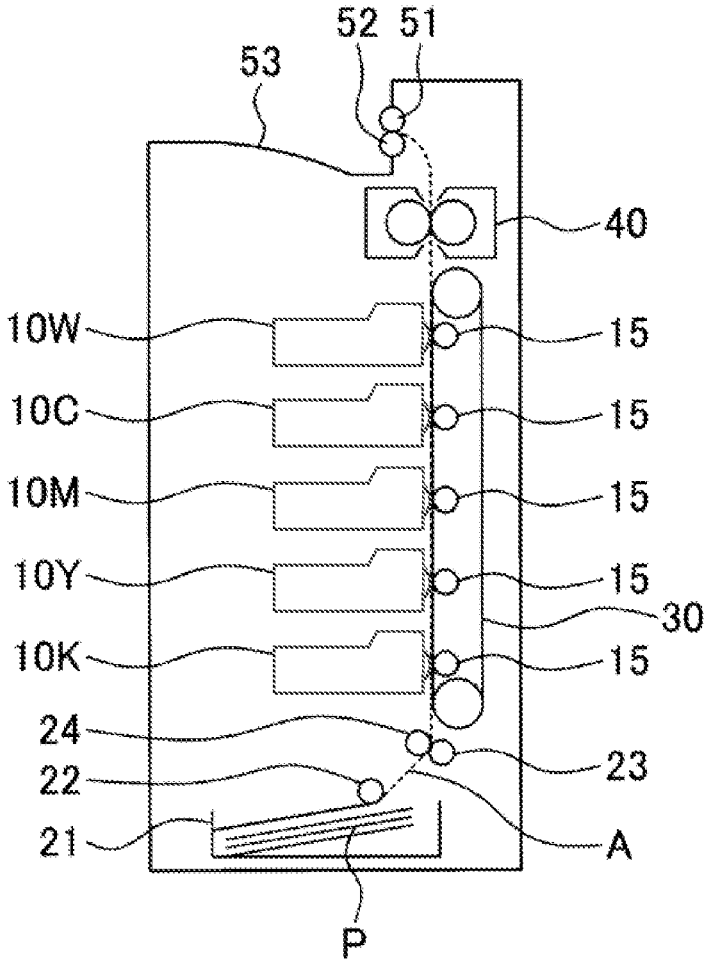
FIG. 14 illustrates a schematic cross-sectional view illustrating a configuration of an image forming apparatus in a third embodiment.
Figure 15:
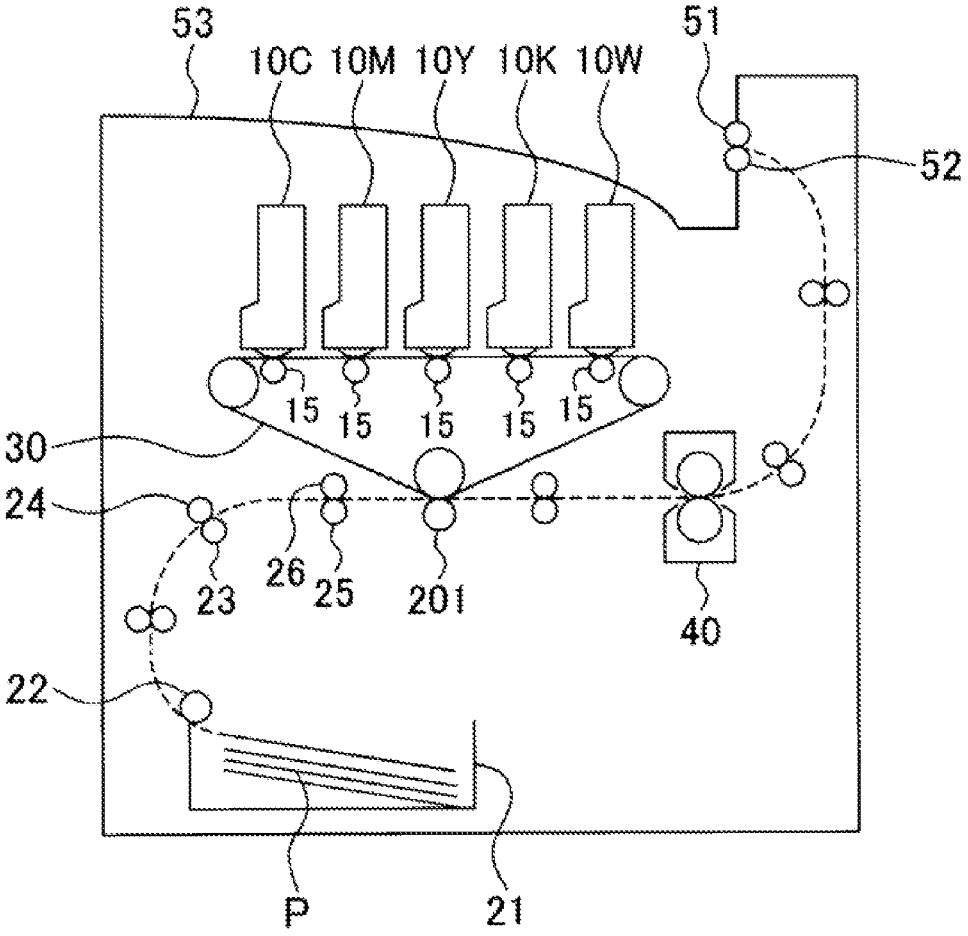
FIG. 15 illustrates a schematic cross-sectional view illustrating an example of a toner layer transferred onto a print medium in cover printing of the third embodiment.

FIG. 14 illustrates a schematic cross-sectional view illustrating a configuration of an image forming apparatus 300 in a third embodiment. In the following, with reference to FIG. 14, the image forming apparatus 300 in the third embodiment is described. In the following description, a portion that is the same as for the first embodiment is omitted or simplified, and an element that is the same as or corresponding to that in the first embodiment is indicated using the same reference numeral symbol.

In FIG. 14, the image forming apparatus 300 includes the image forming parts 10K, 10Y, 10M, 10C as the first image forming parts and an image forming part 10T as the second image forming part. The image forming parts 10K, 10Y, 10M, 10C, similar to those in the first embodiment, each use a color developer other than a white developer as a first developer to form, on the print medium P, a color developer image as a first developer image that represents an image. The image forming part 10T uses a transparent developer as a second developer to form, on the print medium P, a transparent developer image as a second developer image that serves as a covering of a developer image that represents an image. Specifically, the image forming parts 10K, 10Y, 10M, 10C respectively use black (K), yellow (Y), magenta (M) and cyan (C) toners to form color toner images of the respective colors. The image forming part 10T uses a transparent toner (or clear toner) that is a toner of a clear (T) color to form a transparent toner image that serves as a covering of the color toner images. In the following description, the image forming parts 10K, 10Y, 10M, 10C may be referred to as "color image forming parts" and the image forming part 10T may be referred as a "transparent image forming part." In an example of FIG. 14, along the carrying route A of the print medium P, from an upstream side in the medium carrying direction, the color image forming parts 10K, 10Y, 10M, 10C are arranged in this order and on a downstream side thereof (or at a most downstream position), the transparent image forming part 10T is arranged. Therefore, during image formation, toner images of the K, Y, M, C, T colors are formed in this order on the print medium P. The image forming parts 10K, 10Y, 10M, 10C, 10T, similar to those in the first embodiment, each have a configuration illustrated in FIG. 2. In the following description, the alphabet T that indicates a color may be attached as needed to the reference numeral symbols of the members of the image forming part 10T.

In the present embodiment, by superimposing and forming the transparent toner image on the color toner images, gloss of a print material is adjusted. Specifically, by superimposing and forming the transparent toner image on the color toner images using a transparent toner that has a melting point higher than those of the color toners, gloss of a print material is suppressed.

As the color toners, those similar to the color toners in the first embodiment are used. The transparent toner is configured by toner base particles and external additives (such as a charge control agent and an antioxidant) that are added to the toner base particles, the toner base particles being formed by mixing a binder resin and wax and causing the mixture to agglomerate. As the binder resin of the transparent toner, in order to suppress the gloss, a binder resin having a molecular weight larger than that of the binder resin of the color toners is used. For example, a polyester resin is used as the binder resin of the color toners and a styrene-acrylic copolymer resin is used as the binder resin of the transparent toner. Further, here, the transparent toner is colorless and transparent. In order to gain high transparency, colorants such as dyes and pigments are not added to the transparent toner.

In the following, the controller 60 of the present embodiment is described. The controller 60 performs control in a case where a color toner image and a transparent toner image are superimposed and formed and in a case where a color toner image is formed without being superimposed with a transparent toner image. Specifically, the controller 60 controls the image forming parts 10K, 10Y, 10M, 10C, 10T to perform third image formation in which a color toner image and a transparent toner image are superimposed and formed on the print medium P and fourth image formation in which a color toner image is formed on the print medium P without being superimposed with a transparent toner image. More specifically, the controller 60 performs the third image formation in which a color toner image and a transparent toner image as a covering of the color toner image are superimposed and formed, and performs the fourth image formation in which a color toner image is formed without being superimposed with a transparent toner image as a covering of the color toner image. The transparent toner image as a covering may be formed on an entire printable area of the print medium P and may also be formed on a portion of the printable area of the print medium P. In the following description, the third image formation is referred to as "cover printing" and the fourth image formation is referred to as "ordinary printing."

Here the ordinary printing and the cover printing are described. Similar to the first embodiment, as illustrated in FIG. 4, in the ordinary printing, a black toner layer TLk, a yellow toner layer TLy, a magenta toner layer TLm and a cyan toner layer TLc are formed on the print medium P.

As illustrated in FIG. 5, in the cover printing, on the print medium P, a black toner layer TLk, a yellow toner layer TLy, a magenta toner layer TLm and a cyan toner layer TLc are formed, and further a transparent toner layer TLt is formed thereon. The transparent toner layer TLt is, for example, uniformly formed on the entire printable area of the print medium P and configures a cover layer. Typically, the print medium P is a white medium such as a paper medium and an image formed on the print medium P is observed from a toner layer side, that is, a printing surface side, of the print medium P.

In one example, weight per unit area of the color toner layer of each of the respective colors formed on the print medium P is 0.4-0.6 mg/cm2, whereas weight per unit area of the transparent toner layer is 0.2-0.4 mg/cm2.

In an area where a color toner image and a transparent toner image are superimposed and formed, it is possible that image grade may decrease, such as that, due to an influence of the transparent toner image, a density of the color toner image may become lower than a desired density corresponding to the image data. Specifically, the color toner layer and the transparent toner layer on the print medium P are heated and pressed by the fuser device 40 are fused on the print medium P. The color toner has a low melting point so that the color toner layer after fusion has a uniform and flat surface and the gloss is high. On the other hand, the transparent toner has a high melting point so that the transparent toner layer after fusion has a rough uneven surface and the gloss is low. Therefore, by superimposing the transparent toner in printing, a print material with reduced gloss is obtained. However, in the case where the transparent toner layer is superimposed and formed on the color toner layer, due to the unevenness of the surface of the transparent toner layer, light is irregularly reflected by the transparent toner layer. Thereby, as compared to the case where the transparent toner layer is not formed, the density of the color image is reduced. Therefore, a difference occurs in the density of the color image in the case where the transparent toner image is superimposed and the case where the transparent toner image is not superimposed.

From a viewpoint of suppressing the above-described decrease in image grade, the controller 60 increases amount of the color toner used to form the color toner image in the case where the color toner image and the transparent toner image are superimposed and formed on the print medium P as compared to the case where the color toner image is formed on the print medium P without being superimposed with the transparent toner image. Or, the controller 60 increases the toner amount (or density) of the color toner image formed in an area where the transparent toner image is formed to be larger than the toner amount (or density) of the color toner image in an area where the transparent toner image is not formed. For example, the controller 60 increases the toner amount of the color toner image by increasing an area of the color toner image.

Specifically, the controller 60 controls the color image forming parts 10K, 10Y, 10M, 10C in such a manner that the toner amount of the color toner image is increased or the area of the color toner image is increased. More specifically, the controller 60 changes an image forming condition when the color toner image is formed in the color image forming parts 10K, 10Y, 10M, 10C in such a manner that the toner amount of the color toner image is increased or the area of the color toner image is increased. In the present embodiment, the controller 60 changes the potential difference between the photosensitive drum 11 and the development roller 81 as the image forming condition. Specifically, the controller 60 changes the development voltage Vd applied to the development roller 81. In the present example, the controller 60 increases the toner amount of the color toner image by increasing an absolute value of the development voltage Vd applied to the development roller 81.

Figure 16:
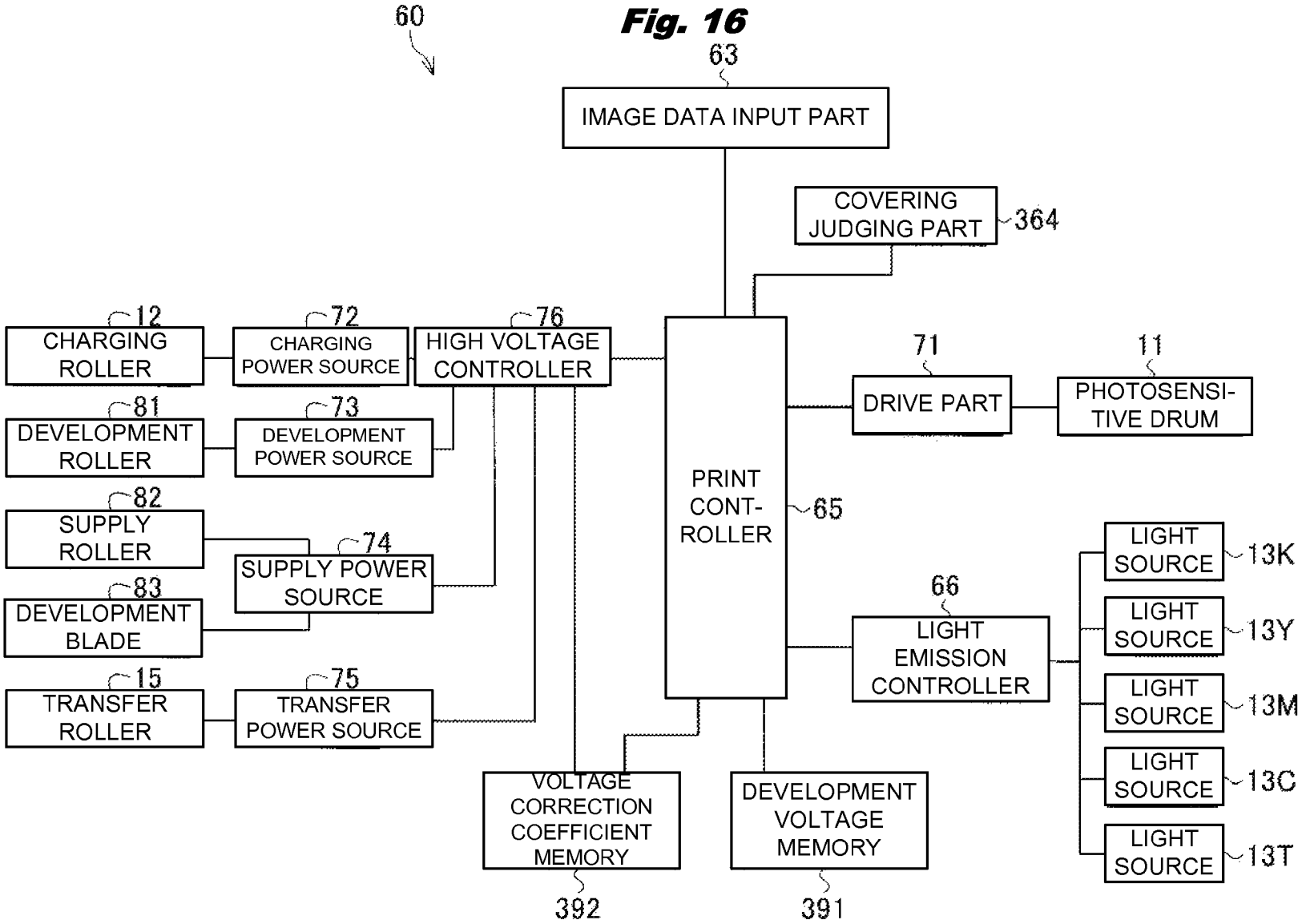
FIG. 16 illustrates a block diagram of an example of a configuration of a controller in the third embodiment.

FIG. 16 illustrates a block diagram of an example of a configuration of the controller 60 in the third embodiment. In the following, with reference to FIG. 16, a specific configuration example of the controller 60 in the third embodiment is described.

In FIG. 16, the controller 60 has a development voltage memory 391, a voltage correction coefficient memory 392, the image data input part 63, a cover judgment part 364, the print controller 65, the light emission controller 66 and the high voltage controller 76.

The development voltage memory 391 stores voltages Vk, Vy, Vm, Vc, Vt that are the development voltages Vd of the K, Y, M, C, T colors when performing the ordinary printing. The development voltages Vd of the respective colors are each independently controlled and the voltages Vk, Vy, Vm, Vc, Vt may be different from each other.

The voltage correction coefficient memory 392 stores a correction coefficient ΔV (>1) that is used to correct the development voltage Vd when performing the cover printing.

The image data input part 63, similar to that in the first embodiment, sends input image data to the print controller 65. The image data includes a covering setting value indicating ON/OFF of a covering.

The cover judgment part 364 judges whether or not the image data sent from the image data input part 63 to the print controller 65 is image data to be covering-printed and notifies the print controller 65 of a judgment result. Specifically, the cover judgment part 364 notifies the print controller 65 of covering ON when the covering setting value of the image data is ON and notifies the print controller 65 of covering OFF when the covering setting value is OFF.

The print controller 65 controls each part of the image forming apparatus 100 based on the image data from the image data input part 63 and the judgment result from the cover judgment part 364 and prints an image corresponding to the image data on the print medium P. The print controller 65 performs the ordinary printing when the judgment result is covering OFF and performs the cover printing when the judgment result is covering ON.

In print control, similar to the first embodiment, the print controller 65 sends the image data of the respective colors to the light emission controller 66. Further, in the case of covering ON, the print controller 65 sends covering image data representing a covering image that is prepared in advance to the light emission controller 66. For example, the covering image data is image data of an entire-surface solid image for which the gradation values of all dots are set to be $\alpha i=1$.

In the case of covering OFF, the print controller 65 obtains the voltages Vk, Vy, Vm, Vc, Vt stored in the development voltage memory 391 and sends the voltages Vk, Vy, Vm, Vc, Vt to the high voltage controller 76.

In the case of covering ON, the print controller 65 obtains the voltages Vk, Vy, Vm, Vc, Vt stored in the development voltage memory 391 and the correction coefficient ΔV stored in the voltage correction coefficient memory 392, and sends voltages Vk·ΔV, Vy·ΔV, Vm·ΔV, Vc·ΔV, Vt to the high voltage controller 76.

The light emission controller 66, similar to that in the first embodiment, controls light emission of the light source 13 of each color based on the image data of the each color and forms an electrostatic latent image on the surface of the photosensitive drum 11 of the each color. However, in the present embodiment, the correction control of the exposure amount is not performed.

The high voltage controller 76, according to an instruction from the print controller 65, controls the charging power source 72, the development power source 73, the supply power source 74 and the transfer power source 75 to respectively apply biases to the charging roller 12, the development roller 81, the supply roller 82 and the development blade 83, and the transfer roller 15.

In the case of covering OFF, the high voltage controller 76 respectively applies the voltages Vk, Vy, Vm, Vc as the development voltage Vd to the development rollers 81K, 81Y, 81M, 81C.

In the case of covering ON, the high voltage controller 76 respectively applies the voltages Vk·ΔV, Vy·ΔV, Vm·ΔV, Vc·ΔV, Vt as the development voltage Vd to the development rollers 81K, 81Y, 81M, 81C, 81T of the respective colors.

In FIG. 16, the controller 60 further has the drive part 71, the charging power source 72, the development power source 73, the supply power source 74 and the transfer power source 75. These parts are the same as in the first embodiment.

Figure 17:
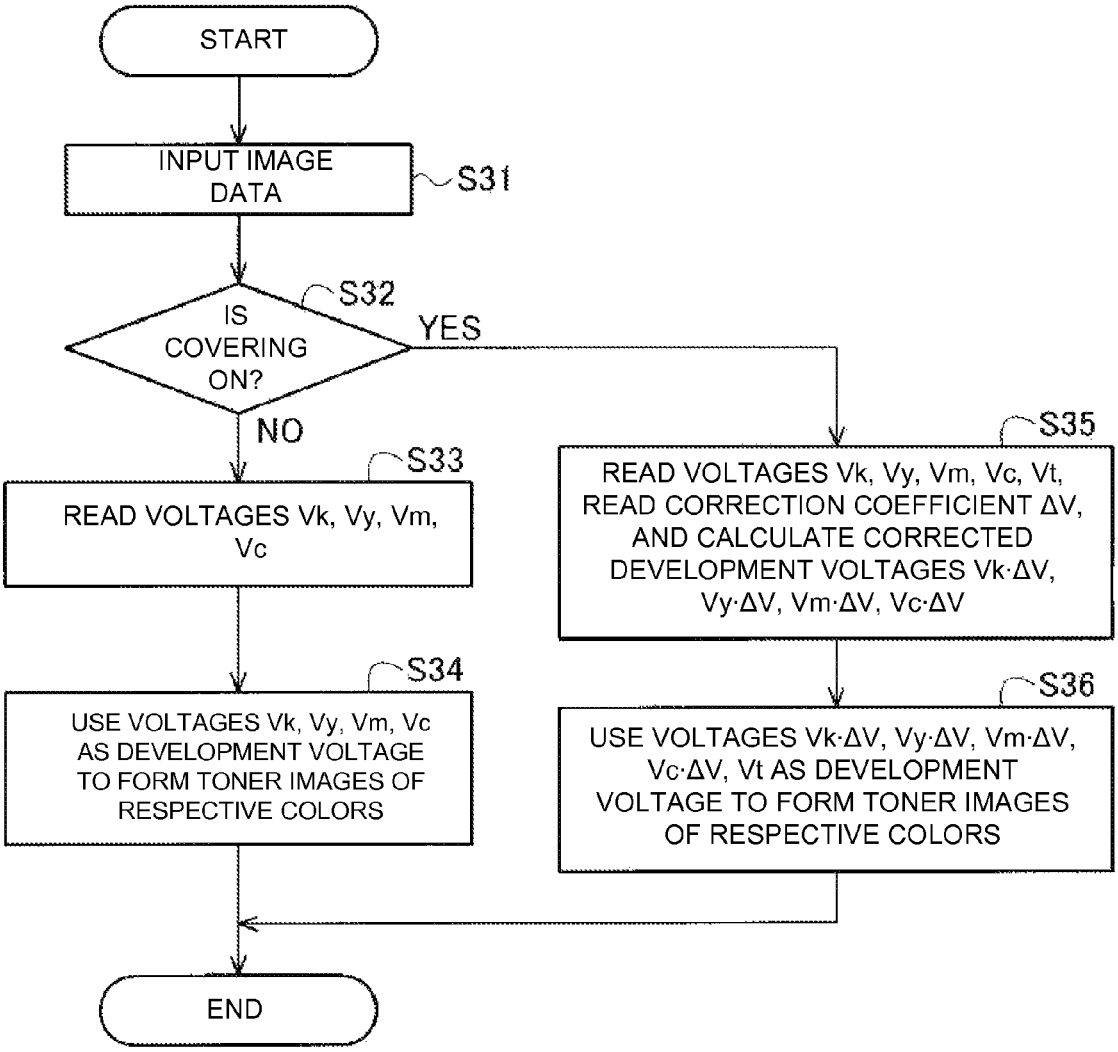
FIG. 17 illustrates a flow diagram illustrating steps of development voltage control in the third embodiment.

FIG. 17 illustrates a flow diagram illustrating steps of development voltage control in the third embodiment. In the following, with reference to FIG. 17, the development voltage control is described.

At S31, the print controller 65 receives input of image data from the image data input part 63 and proceeds to S32. The image data includes image data of the K, Y, M, C colors and a covering setting value.

At S32, the print controller 65 sends the input image data to the cover judgment part 364, receives from the cover judgment part 364 a judgment result indicating covering ON or covering OFF, and proceeds to S33 in the case of covering OFF and S35 in the case of covering ON.

At S33, the print controller 65 reads the voltages Vk, Vy, Vm, Vc from the development voltage memory 391, and proceeds to S34.

At S34, the print controller 65 controls the high voltage controller 76 to form toner images of the K, Y, M, C colors by respectively applying the voltages Vk, Vy, Vm, Vc obtained at S33 as the development voltage Vd to the development rollers 81K, 81Y, 81M, 81C. When the formation of the toner image is completed, the process terminates.

At S35, the print controller 65 reads the voltages Vk, Vy, Vm, Vc, Vt from the development voltage memory 391 and the correction coefficient ΔV from the voltage correction coefficient memory 392, calculates corrected development voltages Vk·ΔV, Vy·ΔV, Vm·ΔV, Vc·ΔV, and proceeds to S36.

At S36, the print controller 65 controls the high voltage controller 76 to form toner images of the K, Y, M, C colors by respectively applying the corrected development voltages Vk·ΔV, Vy·ΔV, Vm·ΔV, Vc·ΔV obtained at S35 as the development voltage Vd to the development rollers 81K, 81Y, 81M, 81C. Further, the print controller 65 applies the voltage Vt as the development voltage Vd to the development roller 81T to form a toner image of the T color as a cover layer. When the formation of the toner image is completed, the process terminates.

In the following, results of evaluation performed using the above image forming apparatus 300 are illustrated. In the present evaluation, under various conditions, an image of the cyan (C) color is printed and a density and a glossiness of the print image were measured. Specifically, measurements of a reference example 3, a comparative example 3 and examples 10-40 were performed under the following conditions.

Reference example 3: covering OFF, development voltage Vd=Vc

Comparative example 3: covering ON, development voltage Vd=Vc

Example 10: covering ON, development voltage Vd=Vc×1.1

Example 11: covering ON, development voltage Vd=Vc×1.2

Example 12: covering ON, development voltage Vd=Vc×1.3

Example 13: covering ON, development voltage Vd=Vc×1.4

Example 14: covering ON, development voltage Vd=Vc×1.5

Figure 18:
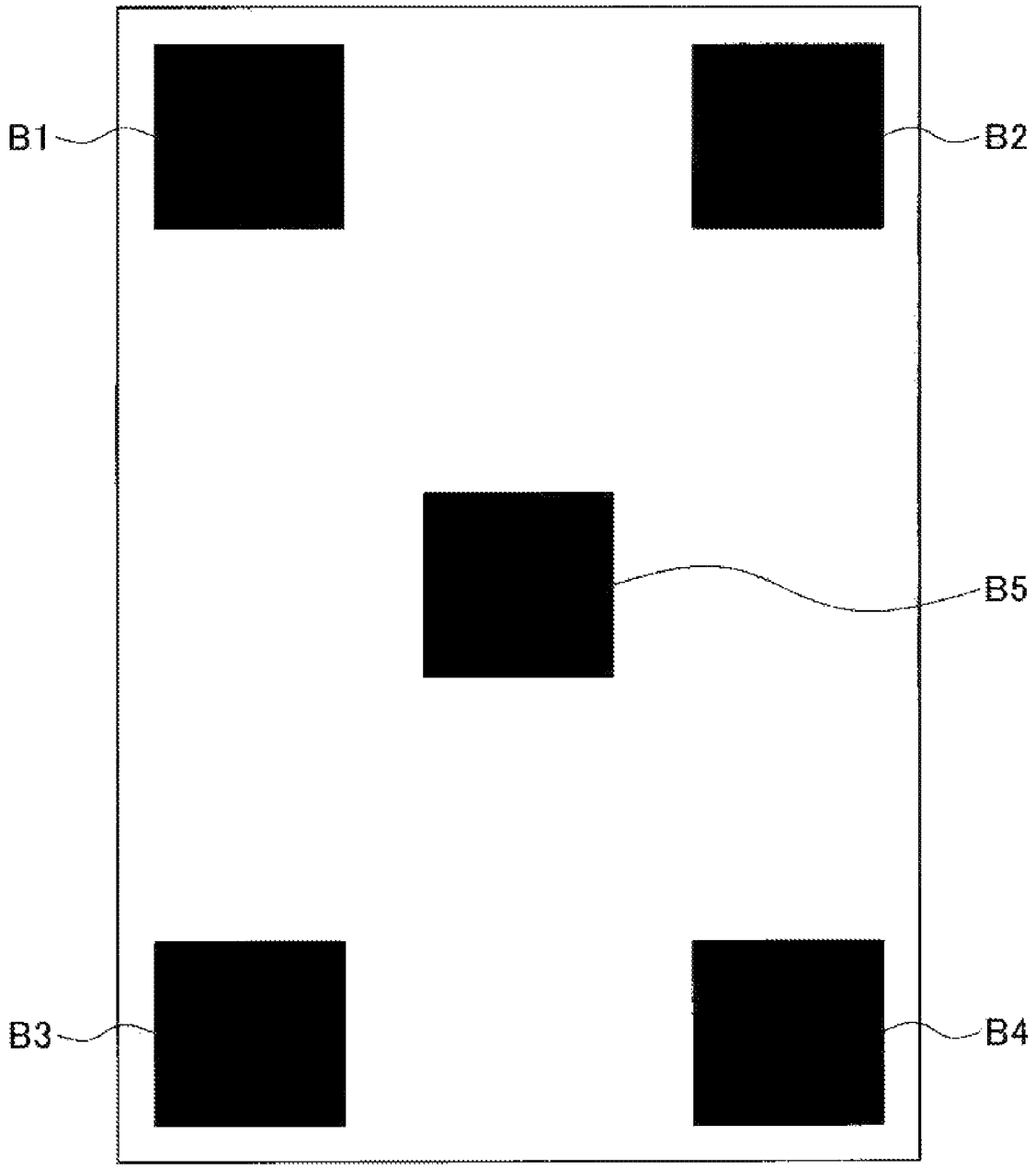
FIG. 18 illustrates a print pattern used in evaluation of the third embodiment.

In the above examples, a print pattern illustrated in FIG. 18 was printed on an A4-size Excellent White sheet (having a basis weight of 80 g/m2) (manufactured Oki Data Corporation as a print medium) with A4 portrait feed at a print speed of 30 ppm (pages per minute) and at a fusing temperature of 170° C. The print patter of FIG. 18 was of an A4-portrait size. In a total of five places including four corners and a center part of the print pattern, rectangular blocks B1-B5 of 5 cm×5 cm were arranged. Each of the blocks was a solid image of 100% duty (that is, having an area ratio of 100%). Densities of the blocks B1-B5 of the five places on the print medium after printing were measured and an average value of the densities of the five places was determined as a density of the print image. A spectrodensitometer X-Rite 528 (manufactured by X-Rite Incorporated) was used for the density measurements. Further, glossinesses of the blocks B1-B5 of the five places on the print medium after printing were measured and an average value of the glossinesses of the five places was determined as a glossiness of the print image. A digital precision gloss meter GM-26D (manufactured by Murakami Color Research Laboratory Co., Ltd.) was used for the glossiness measurements. Table 3 illustrates print conditions and measurement results of the reference example 3, the comparative example 3 and the examples 10-14.

TABLE 3

| | Development Voltage Vd | Covering | Glossiness | Density | Density Judging |
|---|---|---|---|---|---|
| Reference Example 3 | Vc | OFF | 76 | 1.40 | — |
| Comparative Example 3 | Vc | ON | 53 | 1.24 | X |
| Example 10 | Vc × 1.1 (ΔV = 1.1) | ON | 54 | 1.29 | X |
| Example 11 | Vc × 1.2 (ΔV = 1.2) | ON | 54 | 1.35 | ○ |
| Example 12 | Vc × 1.3 (ΔV = 1.3) | ON | 54 | 1.40 | ○ |
| Example 13 | Vc × 1.4 (ΔV = 1.4) | ON | 55 | 1.46 | ○ |
| Example 14 | Vc × 1.5 (ΔV = 1.5) | ON | 55 | 1.51 | X |

An image of the reference example 3 was used as a reference to evaluate images of the comparative example 3 and the examples 10-14. Specifically, densities of print images of the cases of covering ON were evaluated using a range within ±10% of a density of a print image of the reference example 3 as a range of good densities within which a density difference with the case of covering OFF was not felt. In a "Density Judging" column in Table 3, densities that were judged to be good are assigned circle marks and densities that were judged to be not good are assigned cross marks.

Comparing the reference example 3 and the comparative example 3 and the examples 10-14, in the case of the comparative example 3 and the examples 10-14 in which printing was performed with covering ON, the glossiness is reduced by 21-23 with respect to the reference example 3 in which printing is performed with covering OFF. That is, due to the covering by the transparent toner, the gloss of the print image is suppressed.

Comparing the reference example 3 and the comparative example 3, in the comparative example 3 in which printing was performed with covering ON without performing the correction control of the development voltage, the density is smaller by 0.16 with respect to the reference example 3 in which printing is performed with covering OFF, and the density is judged to be not good.

Comparing the comparative example 3 and the examples 10-14, in the examples 10-14 in which the correction control of the development voltage was performed, the densities are larger with respect to the comparative example 3 in which the correction control is not performed.

Comparing the reference example 3 and the example 10, in the example 10 in which the correction was performed with the correction coefficient ΔV=1.1, the density is smaller by 0.11 with respect to the reference example 3 and the density is judged to be not good.

Comparing the reference example 3 and the examples 11-13, in the examples 11-13 in which the correction was performed with the correction coefficient ΔV=1.2-1.4, the densities are within a range of ±0.10 with respect to the reference example 3 and the densities are judged to be good.

Comparing the reference example 3 and the example 14, in the example 14 in which the correction was performed with the correction coefficient ΔV=1.5, the density is larger by 0.11 with respect to the reference example 3 and the density is judged to be not good.

Based on the above evaluation results, it is preferable that, when a color toner image and a transparent toner image were superimposed and formed (for example, when performing the cover printing), the development voltage in a color image forming part is increased 1.2-1.4 times as compared to when a color toner image is formed without being superimposed with a transparent toner image (for example, when performing the ordinary printing). For example, it is preferable that, when performing the correction control in which the development voltage is increased by ΔV times, the correction coefficient ΔV is set to be in a range of 1.2-1.4.

As described above, in the present embodiment, in the case where a first developer image that represents an image and a second developer image that serves as a covering of the first developer image are superimposed and formed on an image-formed body, the image forming apparatus increases the amount of a first developer used to form the first developer image as compared to the case where the first developer image is formed on the image-formed body without being superimposed with the second developer image. Therefore, in the case where a developer image that represents an image and a developer image that serves as a covering of the image are superimposed and formed on an image-formed body, a decrease in image grade, such as a decrease in image density due to the developer image that serves as a covering, can be suppressed and a good image can be obtained. Further, in the present embodiment, in the case where a color first developer image and a transparent second developer image are superimposed and formed on an image-formed body, the image forming apparatus increases the amount of a first developer used to form the first developer image as compared to the case where the first developer image is formed on the image-formed body without being superimposed with the second developer image. Therefore, in the case where a color developer image and a transparent developer image are superimposed and formed on an image-formed body, a decrease in image quality, such as a decrease in image density due to the transparent developer image, can be suppressed and a good image can be obtained. Specifically, in the case where a color toner image and a transparent toner image are superimposed and formed on an image-formed body, as compared to the case where the color toner image is formed on the image-formed body without being superimposed with the transparent toner image, the toner amount of the color toner image is increased. Thereby, by increasing the density of the color toner image, a decrease in the density of the image due to the superposition of the transparent toner image can be suppressed. Therefore, an image having little density difference as compared with the case where the transparent toner image is not superimposed can be obtained.

The present invention is not limited to the above embodiments, but can be embodied in various forms within the scope without departing from the spirit of the present invention.

For example, in the above description, a configuration is illustrated as an example in which the irradiation light quantity li for forming one dot is variably controlled. However, the irradiation light quantity li may also be fixed to be the reference light quantity L. That is, the light emission control of the LED 13*a* is not limited to a multi-value control, but may also be a two-value control of light emission/no-emission. In this case, the area ratio SR=(M/N)×100(%).

Further, in the evaluation of the above first and second embodiments, it is illustrated that the dot diameter is increased by changing the exposure amount and the development voltage. However, this is an example. For example, in a case of a thin line, a line width is increased.

Further, in the above third embodiment, a configuration is illustrated in which, as the image forming condition, the development voltage is changed. However, instead of or in addition to changing the development voltage, similar to the first embodiment, as the image forming condition, the exposure amount may also be changed.

Further, in the above description, a configuration is illustrated in which, as the image forming condition, the exposure amount or the development voltage is changed. However, as far as the toner amount can be changed, it is also possible to have a configuration in which another image forming condition is changed. For example, it is also possible that, by changing the charging voltage as the image forming condition, the surface potential of the photosensitive drum 11 is changed and thus the toner amount is changed.

Further, in the above description, a configuration is illustrated in which the white image forming part 10W is arranged on a downstream side (or at a most downstream position) of the color image forming parts 10K, 10Y, 10M, 10C in the medium carrying direction. However, the white image forming part 10W may also be arranged on an upstream side (or at a most upstream position) of the color image forming parts 10K, 10Y, 10M, 10C. In this configuration, a white toner image is formed on a print medium and a color toner image is formed on the white toner image. In the case, for example, when a print medium of a color other than white is used, the color of the surface of the print medium can be covered by the white toner.

Further, in the above description, a configuration is illustrated in which a color developer image is formed as a first developer image that represents an image. However, it is also possible that a white developer is used as a first developer and a white developer image is formed as a first developer image that represents an image. For example, it is also possible that a white toner image that represents an image is formed on an transparent film and a color toner image is formed as a base on the white toner image. Further, it is also possible that a white toner image is formed that represents an image on a color sheet of a color other than white and a transparent toner image is formed thereon as a covering.

Figure 19:
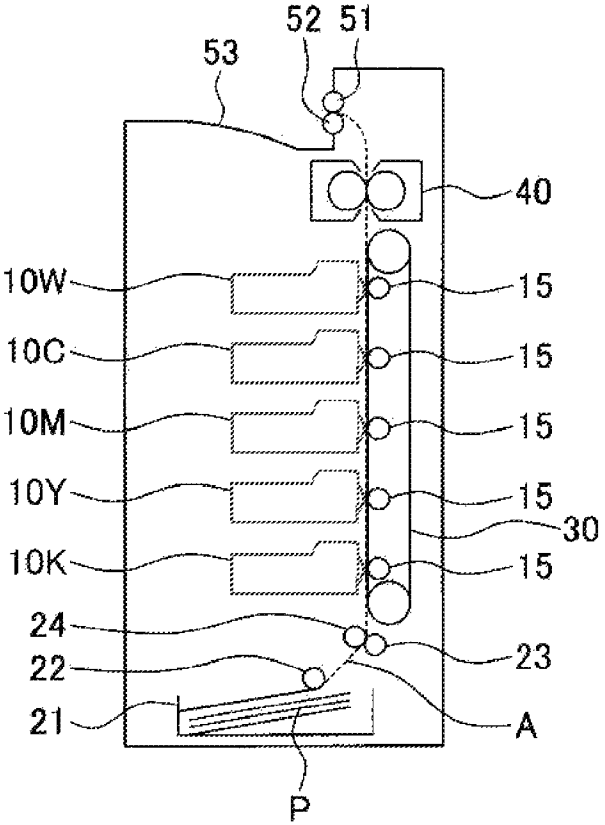
FIG. 19 illustrates a schematic diagram illustrating a modified embodiment of the image forming apparatus.

Further, in the above description, a configuration is illustrated in which the image forming parts 10K, 10Y, 10M, 10C, 10W are arranged above the carrying belt 30 (or the print medium P) in the vertical direction. However, positional relation between the carrying belt 30 and the image forming parts is not limited to this. For example, as illustrated in FIG. 19, the carrying belt 30 and the image forming parts may also be arranged to oppose each other in a horizontal direction. In FIG. 19, an element that is the same as or corresponding to that in FIG. 1 is indicated using the same reference numeral symbol. In FIG. 19, the image forming parts 10K, 10Y, 10M, 10C, 10W are arranged side by side in the vertical direction and the print medium P is carried by the carrying belt 30 upward in vertical direction. In FIG. 19, it is also possible that, in place of the image forming part 10W, the image forming part 10T is arranged.

Figure 20:
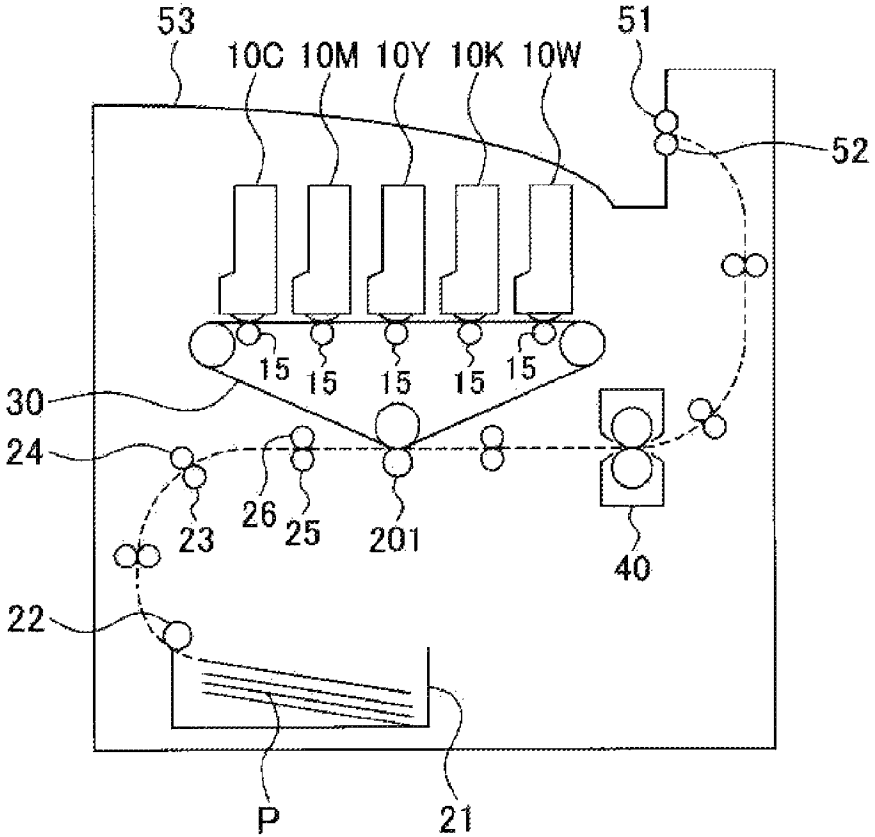
FIG. 20 illustrates a schematic diagram illustrating another modified embodiment of the image forming apparatus.

Further, in the above description, an image forming apparatus of a direct transfer system is illustrated. However, without being limited to this, for example, the present invention is also applicable to an image forming apparatus of an intermediate transfer system. FIG. 20 illustrates a schematic diagram illustrating a configuration of an image forming apparatus of an intermediate transfer system. In FIG. 20, an element that is the same as or corresponding to that in FIG. 1 is indicated using the same reference numeral symbol. In FIG. 20, toner images of the respective colors are sequentially primarily transferred by the image forming parts 10W, 10K, 10Y, 10M, 10C to a surface of the carrying belt (or transfer belt) 30 as a first image-formed body. The toner images of the respective colors that are primarily transferred to the carrying belt 30 are secondarily transferred by a secondary transfer device 201 to the print medium P as second image-formed body. The toner images that are secondarily transferred to the print medium P are fused by the fuser device 40 and thereafter is ejected to the stacker part 53. In FIG. 20, it is also possible that, in place of the image forming part 10W, the image forming part 10T is arranged.

Further, in the above description, an image forming apparatus of a tandem type in which photosensitive drums of a plurality of colors are arranged. However, without being limited to this, the present invention is also applicable to an image forming apparatus of a one-drum type in which one photosensitive drum is used to form a toner image of a plurality of colors.

Further, the image forming apparatus is not limited to a color printer, but may also be a facsimile machine, a copy machine, and the like.

What is claimed is:

1. An image forming apparatus, comprising:

a first image forming part that forms a first developer image representing an image by using a first developer; and a second image forming part that forms a second developer image serving as a base or covering of the first developer image by using a second developer, wherein in a case where the first developer image and the second developer image are superimposed and formed on an image-formed body by the first image forming part and the second image forming part, amount of the first developer that is used to form the first developer image is increased as compared to a case where the first developer image is formed on the image-formed body by the first image forming part without being superimposed with the second developer image.

2. The image forming apparatus according to claim 1, wherein the amount of the first developer is increased by increasing an area of the first developer image that is formed by the first image forming part.

3. The image forming apparatus according to claim 1, wherein the amount of the first developer is increased by changing an image forming condition when the first developer image is formed by the first image forming part.

4. The image forming apparatus according to claim 3, wherein the first image forming part comprises an image carrier;

an exposure part that exposes the image carrier to form a latent image; and a developer carrier that uses the first developer to develop the latent image, which is formed on the image carrier, to form the first developer image, wherein the image forming apparatus changes an exposure amount of the exposure part as the image forming condition.

5. The image forming apparatus according to claim 3, wherein the first image forming part comprises an image carrier;

an exposure part that exposes the image carrier to form a latent image; and a developer carrier that uses the first developer to develop the latent image, which is formed on the image carrier, to form the first developer image, wherein the image forming apparatus changes a voltage that is applied to the developer carrier as the image forming condition.

6. The image forming apparatus according to claim 1, comprising:

a fuser that fuses the first developer image and the second developer image that are formed on the image-formed body.

7. The image forming apparatus according to claim 1, wherein in the case where the first developer image and the second developer image are superimposed and formed on the image-formed body, the second developer image is formed on top of the first developer image.

8. The image forming apparatus according to claim 1, wherein the second developer is white or transparent.

9. An image forming apparatus, comprising:

a first image forming part that forms a color first developer image by using a color first developer; and a second image forming part that forms a white or transparent second developer image by using a white or transparent second developer, wherein in a case where the first developer image and the second developer image are superimposed and formed on an image-formed body by the first image forming part and the second image forming part, amount of the first developer that is used to form the first developer image is increased as compared to a case where the first developer image is formed on the image-formed body by the first image forming part without being superimposed with the second developer image.

10. The image forming apparatus according to claim 9, wherein the amount of the first developer is increased by increasing an area of the first developer image that is formed by the first image forming part.

11. The image forming apparatus according to claim 9, wherein the amount of the first developer is increased by changing an image forming condition when the first developer image is formed by the first image forming part.

12. The image forming apparatus according to claim 11, wherein the first image forming part comprises an image carrier;

an exposure part that exposes the image carrier to form a latent image; and a developer carrier that uses the first developer to develop the latent image, which is formed on the image carrier, to form the first developer image, wherein the image forming apparatus changes an exposure amount of the exposure part as the image forming condition.

13. The image forming apparatus according to claim 11, wherein the first image forming part comprises an image carrier;

an exposure part that exposes the image carrier to form a latent image; and a developer carrier that uses the first developer to develop the latent image, which is formed on the image carrier, to form the first developer image, wherein the image forming apparatus changes a voltage that is applied to the developer carrier as the image forming condition.

14. The image forming apparatus according to claim 9, wherein in the case where the first developer image and the second developer image are superimposed and formed on the image-formed body, the second developer image is formed on top of the first developer image.

* * * * *